US011136812B2

(12) United States Patent
Rabinowitz et al.

(10) Patent No.: US 11,136,812 B2
(45) Date of Patent: Oct. 5, 2021

(54) MOTORIZED DOOR OPENING DEVICE

(71) Applicant: Milbat—Giving Quality to Life, Ramat-Gan (IL)

(72) Inventors: Abraham Samuel Rabinowitz, Givat Shmuel (IL); Nachman Plotnitzki, Ganei-Tikva (IL); Uriah Oz-Shannon, Kibbutz Saad (IL)

(73) Assignee: Milbat—Giving Quality to Life, Ramat-Gan (IL)

( * ) Notice: Subject to any disclaimer, the term of this patent is extended or adjusted under 35 U.S.C. 154(b) by 155 days.

(21) Appl. No.: 16/099,203

(22) PCT Filed: May 9, 2017

(86) PCT No.: PCT/IL2017/050511
§ 371 (c)(1),
(2) Date: Nov. 6, 2018

(87) PCT Pub. No.: WO2017/195197
PCT Pub. Date: Nov. 16, 2017

(65) Prior Publication Data

US 2020/0102779 A1 Apr. 2, 2020

Related U.S. Application Data

(60) Provisional application No. 62/333,337, filed on May 9, 2016.

(51) Int. Cl.
*E05F 11/00* (2006.01)
*E05F 15/624* (2015.01)

(52) U.S. Cl.
CPC ..... *E05F 15/624* (2015.01); *E05Y 2400/322* (2013.01); *E05Y 2800/11* (2013.01); *E05Y 2900/132* (2013.01)

(58) Field of Classification Search
CPC ..... E05F 15/624; E05Y 2400/322; E05Y 2800/11; E05Y 2900/132
(Continued)

(56) References Cited

U.S. PATENT DOCUMENTS 1,631,416 A * 6/1927 Howard ..... E05F 15/624 49/358
1,694,431 A * 12/1928 Russell ..... E05F 15/624 49/358
(Continued)

FOREIGN PATENT DOCUMENTS

DE 1016158 9/1957
DE 102014105853 10/2015
(Continued)

OTHER PUBLICATIONS

International Preliminary Report on Patentability dated Nov. 22, 2018 From the International Bureau of WIPO Re. Application No. PCT/IL2017/050511. (8 Pages).
(Continued)

*Primary Examiner* — Jerry E Redman

(57) ABSTRACT

A motorized door opening device, including at least one wheel, configured to be lowered to a surface and forced thereagainst with a force sufficient to ensure friction between the wheel and the surface and to prevent slipping of the wheel relative to the surface;

an electric motor including a rotor coupled to rotate the wheel;

a wheel actuator, coupled between the door and the wheel, to lower the wheel to the surface in response to a wheel lowering signal; and control circuitry to signal the wheel actuator to lower the wheel by generating the wheel lowering signal and push down the wheel to create friction; and a door attachment member to attach the motor and the wheel actuator to a bottom part of the door;

(Continued)

whereby rotation of the wheel after lowering of the wheel causes the wheel to rotate in contact with the surface and move the door.

16 Claims, 31 Drawing Sheets

(58) Field of Classification Search
USPC ..... 49/358
See application file for complete search history.

(56) References Cited

U.S. PATENT DOCUMENTS

| | | | | |
|---|---|---|---|---|
| 2,827,284 | A * | 3/1958 | Bunzl | E05F 15/624 49/32 |
| 4,501,090 | A | 2/1985 | Yoshida et al. | |
| 4,520,592 | A * | 6/1985 | Holloway | E05F 15/624 49/25 |
| 4,754,572 | A * | 7/1988 | Bilt | E05F 15/632 49/358 |
| 5,278,480 | A | 1/1994 | Murray | |
| 5,425,155 | A | 6/1995 | Marciniak | |
| 5,555,779 | A | 9/1996 | Holden | |
| 5,878,530 | A | 3/1999 | Eccleston et al. | |
| 6,108,975 | A | 8/2000 | Bailey | |
| 7,021,005 | B1 * | 4/2006 | Curry | E05F 15/624 49/358 |
| 7,261,344 | B1 | 8/2007 | Drake, Jr. et al. | |
| 7,938,464 | B1 | 5/2011 | Hielm | |
| 8,353,546 | B1 | 1/2013 | Cacas | |
| 8,390,219 | B2 | 3/2013 | Houser | |
| 8,869,449 | B2 | 10/2014 | El Fassi et al. | |
| 9,725,941 | B2 * | 8/2017 | Van Tassell, III | E05F 15/60 |
| 2002/0175827 | A1 | 11/2002 | Klein et al. | |
| 2004/0103584 | A1 * | 6/2004 | Freeman | E05F 15/77 49/334 |
| 2007/0186480 | A1 * | 8/2007 | Freeman | E05F 15/624 49/358 |
| 2010/0115853 | A1 * | 5/2010 | Gebhart | H02P 6/085 49/506 |
| 2010/0117578 | A1 | 5/2010 | Hollenbeck | |
| 2012/0272576 | A1 * | 11/2012 | Van Tassell, III | E05F 15/77 49/70 |
| 2012/0304541 | A1 * | 12/2012 | Goodman | B60B 33/0068 49/358 |
| 2013/0318878 | A1 * | 12/2013 | Manseder | E05F 15/624 49/358 |
| 2013/0326960 | A1 * | 12/2013 | Manseder | E05F 15/624 49/358 |
| 2018/0058130 | A1 * | 3/2018 | Shelley | E05F 15/624 |

FOREIGN PATENT DOCUMENTS

| | | |
|---|---|---|
| EP | 2318624 | 5/2011 |
| WO | WO 2017/195197 | 11/2017 |
| WO | WO 2017/195197 A8 | 11/2017 |

OTHER PUBLICATIONS

International Search Report and the Written Opinion dated Aug. 9, 2017 From the International Searching Authority Re. Application No. PCT/IL2017/050511. (13 Pages).

Abotic "Doormatic Automatic Door Opener: Abotic Assistant James. Die neue Generation der Tuerautomatisierung", Youtube.com, Retrieved From the Internet, 2016.

Medical Depot "Doormatic Automatic Door Opener", Medical Depot Inc., Drive DeVilbiss Healthcare, Product Catalog, 5 P., 2015.

SkyLink "Otodor® Swing Door Opener Accessories", Sky-Link Technologies, 4 P., 2013.

Office Action dated Jul. 8, 2021 From the Israel Patent Office Re. Application No. 262896. (3 Pages).

* cited by examiner

Fig. 5A
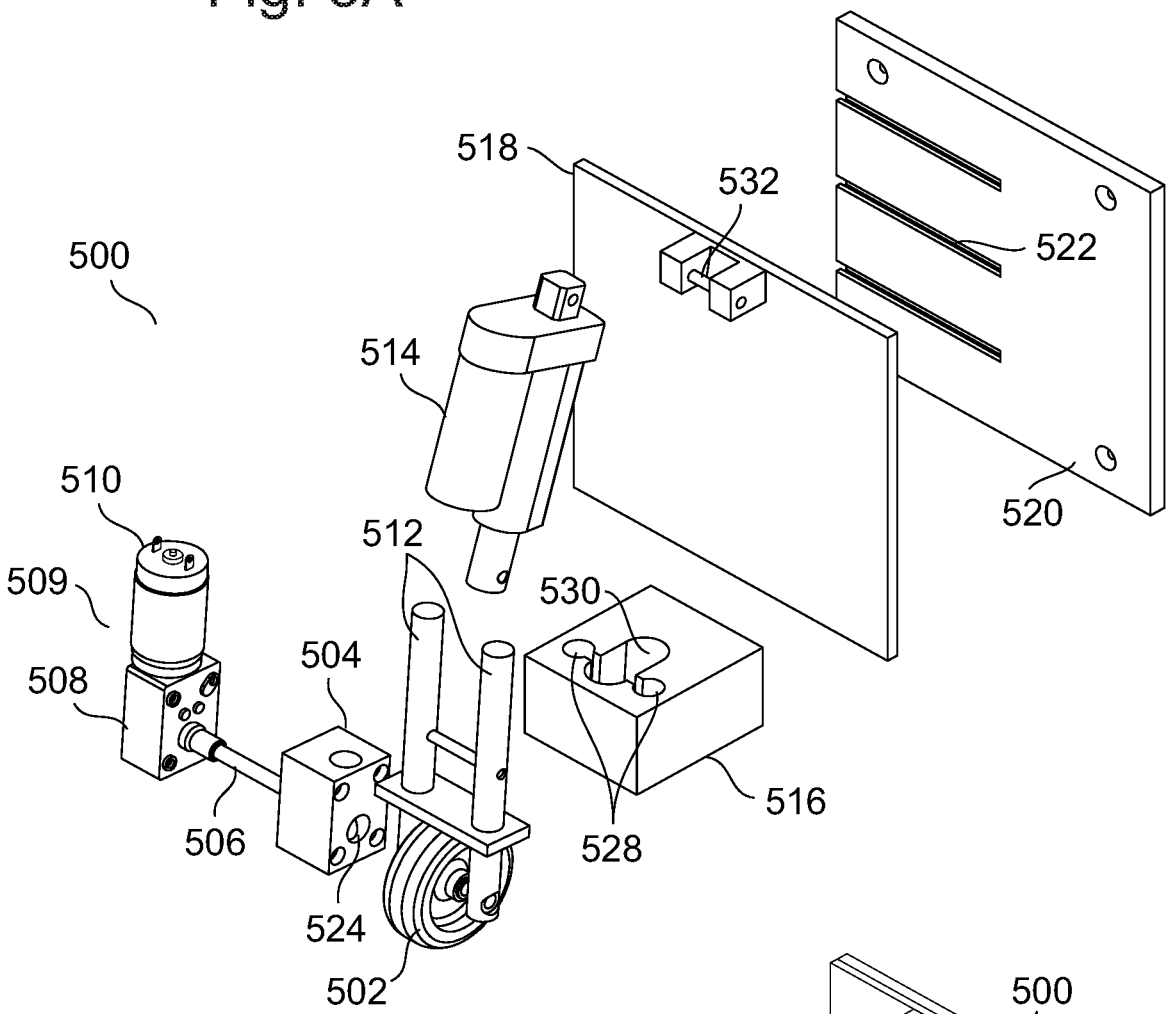
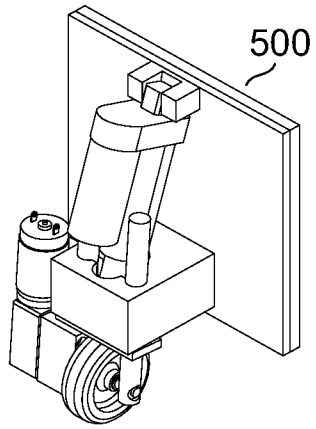
Fig. 5B

MOTORIZED DOOR OPENING DEVICE

RELATED APPLICATIONS

This application is a National Phase of PCT Patent Application No. PCT/IL2017/050511 having International filing date of May 9, 2017 which claims the benefit of priority and under 35 USC § 119(E) of U.S. Provisional Patent Application patent application No. 62/333,337 filed on May 9, 2016. The contents of the above applications of which are all incorporated herein by reference as if fully set forth herein in their entirety.

FIELD AND BACKGROUND OF THE INVENTION

The present invention, in some embodiments thereof, relates to a motorized door opening device and, more particularly, but not exclusively, to a motorized door opening device comprising a wheel and configured to open or close a door upon receiving a signal.

An invention by Eccleston disclosed in U.S. Pat. No. 5,878,530A teaches a remotely controllable door operator system permitting active and passive use of a door. The disclosed system is normally found in a passive mode, which allows manually opening and closing of a door regardless of the system, and shifts into an active mode when receiving an operation signal from a user. When a signal is received, a clutch mechanism is operable and allows selective powered movement of the door between a closed position and an open position.

U.S. Patent Application Publication No. US 2013/0318878 A1 discloses a motorized door opening device configured to open a door by rotating a wheel on a floor surface. The disclosed system, which comprises an electric motor and a wheel, is mounted on a door and is configured to apply a constant pressure, determined by its own weight through the wheel on the floor surface. Upon receiving a signal from a user, the electric motor shifts into operation mode and rotates the wheel until the door is opened. To close the door, the motor continues to work and rotates the wheel in the opposite direction.

Additional background art includes U.S. Patent Application Publication No. US20130326960A1, U.S. Pat. No. 5,278,480A, U.S. Patent Application Publication No. US20100117578A, U.S. Pat. No. 5,878,530A, International Patent Application Publication No. EP2318624B1, U.S. Pat. Nos. 6,108,975A, 4,501,090A, 8,390,219 B2, 5,425,155A, 5,555,779A, 8,869,449B2, 7,261,344 B, 8,353,546 B, U.S. Patent Application Publication No. US20020175827 A1, and U.S. Pat. No. 7,938,464 B1.

SUMMARY OF THE INVENTION

Following are some examples of some embodiments of the invention:

Example 1

A motorized door opening device, comprising:

a) a wheel actuator coupled between a door and at least one wheel, configured to lower said at least one wheel to a surface in response to a wheel lowering signal;

b) an electric motor including a rotor coupled to rotate said at least one wheel; and c) a door attachment member configured to attach said motorized door opening device to the bottom part of said door; whereby rotation of said motor after lowering of said at least one wheel causes said wheel to rotate in contact with said surface and move said door.

Example 2

The device according to example 1, further comprising a control circuitry configured to signal said wheel actuator to lower said wheel by generating said wheel lowering signal.

Example 3

The device according to examples 1 or 2, wherein said wheel actuator further comprising an electric linear actuator including an extendible element coupled to said at least one wheel;

wherein changes in length of said extendible element causes said at least one wheel to be lowered or raised.

Example 4

The device according to example 2, comprising a wireless receiver which signals said control circuitry to generate said lowering signal in response to reception of a wireless signal thereby.

Example 5

The device according to example 4, wherein said wireless signal is transmitted from a distance of up to 3 meters.

Example 6

The device according to any one of the previous examples, wherein wheel actuator has a range of motion of at least 20 mm.

Example 7

The device according to any one of the previous examples, wherein said wheel actuator forces said at least one wheel against said surface with a force greater than gravity.

Example 8

The device according to any one of the previous examples, wherein said motor is strong enough to rotate said wheel against a door resistance of at least 60 Newton.

Example 9

The device according to any one of the previous examples, wherein said motor generates torque of at least 1.5 Nm.

Example 10

The device of example 7, wherein said force is sufficient to ensure friction between said wheel and said surface prevents slipping of said at least one wheel.

Example 11

The device of example 10, comprising circuitry which adapts said force according to said slippage.

Example 12

The device according to any one of the previous examples, further comprising a gear component connected to said electric motor and configured to change the torque delivered to said at least one wheel by said electric motor.

Example 13

The device according to any one of the previous examples, wherein said door is configured to be manually opened by applying a force against said door by a user, when said wheel lowering signal is not received.

Example 14

The device of example 2, further comprising an alert circuitry connected to said control circuitry; wherein said alert circuitry is configured to generate an alert signal to be transmitted by a light-emitting alert component and/or a sound producing alert component.

Example 15

The device according to example 2, further comprising a memory circuitry connected to said control circuitry, wherein said memory circuitry is configured to store operation programs of said device.

Example 16

The device according to any one of the previous examples, wherein said electric motor is coupled to said wheel actuator and is configured to provide power for lowering of said at least one wheel.

Example 17

The device according to any one of the previous examples further comprising a spacer, wherein said spacer is configured to allow lowering and raising of said at least one wheel in a distance of at least 1 mm from said door.

Example 18

The device according to example 12, wherein said gear component is a worm gear.

Example 19

The device according to example 7, wherein said wheel actuator comprises an over current sensor, wherein said force is determined by measuring electric current of said wheel actuator by said current sensor.

Example 20

The device according to any one of the previous examples further comprising a door state sensor for determining a relative and/or an absolute position of the door.

Example 21

The device according to example 20, wherein said door state sensor comprises a gyroscope or an optical sensor.

Example 22

The device according to any one of examples 1 to 19 further comprising an accelerometer for sensing a door movement.

Example 23

The device of example 4, wherein said wireless receiver signals said control circuitry to activate said device in response to reception of a wireless signal from an intercom device.

Example 24

The device of any one of the previous examples further comprising a transmitter which transmits wireless signals to an intercom device.

Example 25

A system for opening a door, comprising a motorized door opening device of example 1, and a remote control, wherein said remote control transmits a wireless signal to said motorized door opening device.

Example 26

The system according to example 25, wherein said remote control comprises a handheld device configured to open said door by transmitting said wireless signal using a software program or an application program.

Example 27

The system according to example 26, wherein said handheld device is operated by a handicapped user.

Example 28

The system according to any one of examples 25 to 27, further comprising a computer device, wherein said motorized door opening device is configured to transmit log files to said computer device.

Example 29

The system according to example 28, wherein said computer device comprises a handheld device configured to receive and display said log files using an application program.

Example 30

The system according to example 29, wherein said computer device adjusts at least one parameter of said motorized door opening device using said application program.

Example 31

The system of any one of examples 25 to 30, further comprising an intercom device, and wherein said motorized door opening device delivers signals to said intercom device by a transmitter of said motorized door opening device.

Example 32

The system of any one of examples 25 to 30, further comprises an intercom device, and wherein said motorized door opening device receives signals from said intercom device by a receiver of said motorized door opening device.

Example 33

A method for opening or closing a door by a motorized door opening device, comprising:

a) receiving a signal to open and/or close a door;

b) lowering at least one wheel to a surface in response to said received signal;

c) rotating said at least one wheel in a desired direction to open or to close said door, after said lowering.

Example 34

The method according to example 33, further comprising:

deciding whether said motorized door opening device works in an automatic mode or in a manual mode, after said receiving.

Example 35

The method according to example 34, wherein if said motorized door opening device works in a manual mode, then said motorized door opening device waits for a second signal to open and/or close said door to be generated by a user using an application program of a handheld device.

Example 36

The method according to example 34, wherein if said motorized door opening device works in an automatic mode, then said motorized door opening device proceeds to said lowering.

Example 37

The method according to any one of examples 33 to 36, further comprising:

determining said door position before said lowering of said at least one wheel.

Example 38

The method according to any one of examples 33 to 37, further comprising:

conducting a setup process to determine the force to be applied by said wheel on said surface.

Example 39

The method according to example 38, wherein said setup process further comprises determining door opening degree and/or wheel rotation time.

Example 40

The method according to examples 38 or 39 further comprising: storing of said setup process parameters and/or values in a memory circuitry of said motorized door opening device.

Example 41

The method according to any one of examples 33 to 40, further comprising:

raising of said at least one wheel.

Example 42

The method according to any one of examples 33 to 41, further comprising applying a force of at least 60 Newton by said motorized door opening device on said door to open said door.

Example 43

The method according to any one of examples 33 to 42 further comprising modifying contact pressure applied by said at least one wheel on said surface, after said lowering.

Example 44

The method according to any one of examples 33 to 43 further comprising generating a human detectable alert signal to alert individuals in the vicinity of said device.

Example 45

The method according to example 44, wherein said human detectable alert signal is generated by a handheld device, in response to a signal from said motorized door opening device.

Example 46

The method according to any one of examples 33 to 45 further comprising transmitting log files to a handheld device.

Example 47

The method according to any one of examples 33 to 46, wherein said receiving comprises receiving signals from an intercom device.

Example 48

The method according to any one of examples 33 to 46, further comprising signaling an intercom device or an electric lock connected to said door to unlock said door prior to said rotating.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

As will be appreciated by one skilled in the art, some embodiments of the present invention may be embodied as a system, method or computer program product. Accordingly, some embodiments of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system". Furthermore, some embodiments of the present invention may take the form of a computer program product embodied in one or more computer readable medium(s) having computer readable program code embodied thereon. Implementation of the method and/or system of some embodiments of the invention can involve performing and/or completing selected tasks manually, automatically, or a combination thereof. Moreover, according to actual instrumentation and equipment of some embodiments of the method and/or system of the invention, several selected tasks could be implemented by hardware, by software or by firmware and/or by a combination thereof, e.g., using an operating system.

For example, hardware for performing selected tasks according to some embodiments of the invention could be implemented as a chip or a circuit. As software, selected tasks according to some embodiments of the invention could be implemented as a plurality of software instructions being executed by a computer using any suitable operating system. In an exemplary embodiment of the invention, one or more tasks according to some exemplary embodiments of method and/or system as described herein are performed by a data processor, such as a computing platform for executing a plurality of instructions. Optionally, the data processor includes a volatile memory for storing instructions and/or data and/or a non-volatile storage, for example, a magnetic hard-disk and/or removable media, for storing instructions and/or data. Optionally, a network connection is provided as well. A display and/or a user input device such as a keyboard or mouse are optionally provided as well.

Any combination of one or more computer readable medium(s) may be utilized for some embodiments of the invention. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium and/or data used thereby may be transmitted using any appropriate medium, including but not limited to wireless, wireline, optical fiber cable, RF, etc., or any suitable combination of the foregoing.

Computer program code for carrying out operations for some embodiments of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Some embodiments of the present invention may be described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

Some of the methods described herein are generally designed only for use by a computer, and may not be feasible or practical for performing purely manually, by a human expert. A human expert who wanted to manually perform similar tasks, such as determining the contact force between a wheel and a surface, might be expected to use completely different methods, e.g., making use of expert knowledge and/or the pattern recognition capabilities of the human brain, which would be vastly more efficient than manually going through the steps of the methods described herein.

BRIEF DESCRIPTION OF THE SEVERAL VIEWS OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings:

FIG. 5A is an exploded view of a motorized door opening device and its components, according to some embodiments of the invention;

FIG. 5B is a schematic view of an assembled device, for example as shown in FIG. 5A, according to some embodiments of the invention;

DESCRIPTION OF SPECIFIC EMBODIMENTS OF THE INVENTION

Figure 1A:
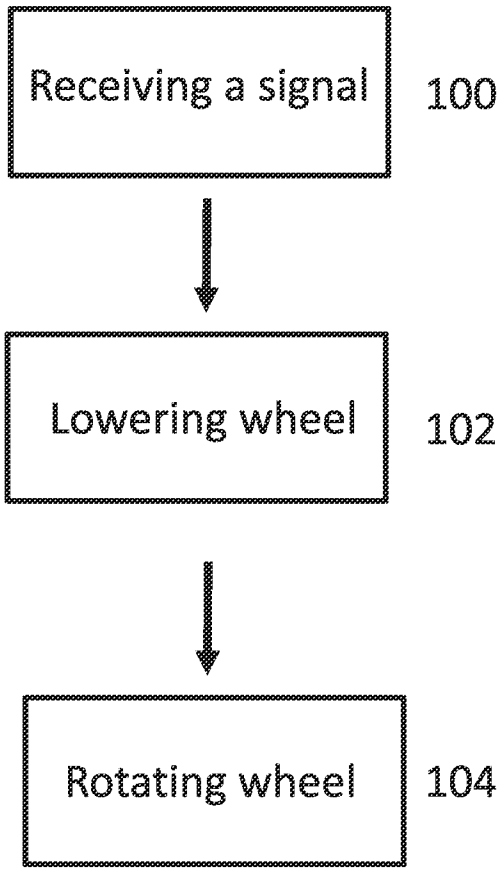
FIG. 1A is a general flow chart of a door opening process using a motorized door opening device, according to some embodiments of the invention.

The present invention, in some embodiments thereof, relates to a motorized door opening device and, more particularly, but not exclusively, to a motorized door open device comprising a wheel and configured to open or close a door upon receiving a signal.

An aspect of some embodiments relates to a motorized door opening device, configured to lower a wheel to a surface upon receiving a signal. In some embodiments, the wheel is connected to the device by a movable shaft, configured to lower or elevate the wheel in response to a signal. In some embodiments, the motorized door opening device is configured to lower or elevate the movable shaft from a floor surface upon receiving a signal. In some embodiments, the motorized door opening device is configured to rotate a wheel in a direction that will cause the door to open or to close. In some embodiments, the motorized door opening device is attached to a door in a position adjacent to the floor surface, that when the wheel is lowered, it will make contact with the floor surface. In some embodiments, the motorized door opening device is activated by a wireless signal, for example a Bluetooth low energy signal. Alternatively, device comprises proximity sensors configured to sense objects near the device and activate the device when the door is closed. Optionally, the activation signal is transmitted from at least one sensor mounted next to the door. In some embodiments, when an object is detected near the device, device stops wheel rotation.

An aspect of some embodiments relates to a motorized door opening device configured to open a door, which is connected to a door closer device. In some embodiments, a motorized door opening device is configured to apply a force to a door, against a resisting force applied to the door by a door closer device. In some embodiments, the force to be applied by the wheel on a surface is pre-determined or is determined during a setup process.

An aspect of some embodiments relates to a motorized door opening device comprising at least one wheel and a wheel actuator, configured to adjust the pressure applied by at least one wheel on a surface. In some embodiments the device is configured to adjust the power delivered to the wheel. In some embodiments the motorized door opening device adjusts the pressure applied by the wheel on the surface, based on the friction level of the wheel with the surface, for example by measuring the rotation speed of the wheel. Alternatively, the motorized door opening device measures changes in the electrical properties of the wheel actuator, for example changes in electrical current. In some embodiments when the level of friction is below a desired level, device adjusts the power delivered to the wheel and/or the pressure applied by the wheel on the floor surface.

An aspect of some embodiment relates to a setup process for determining activation parameters of the motorized door opening device. In some embodiments the setup process is performed before the initial activation of the device and/or during device activation. In some embodiments the setup process comprises adjusting the door opening degree by determining wheel rotation time and/or speed. In some embodiments, the setup process comprises adjusting the pressure applied by the wheel based on floor type and/or texture. Alternatively, the pressure to be applied by the wheel is based on floor incline. In some embodiments, the motorized door opening device comprises a memory circuitry configured to store setup process parameters and/or operation programs of the motorized door opening device.

An aspect of some embodiments relates to reducing the wearing out of motorized door opening device components. In some embodiments the door opening device is configured to raise a wheel when the door is closed. Alternatively, the door opening device is configured to raise the wheel when the device is activated in a manual mode. In some embodiments the wheel is raised when the door reaches a desired opening degree and/or in response to a wireless signal from a remote control or a handheld device.

An aspect of some embodiments relates to reducing the interference of a motorized door opening device for manual opening of a door. In some embodiments when an activation signal is not transmitted by a user, the wheel of a door opening device is raised from the surface to allow manual opening of the door, by reducing the friction with the surface.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Exemplary Method for Opening a Door Using a Motorized Door Opening Device

To most individuals, manually opening and closing of a door is relatively easy. However, for some individuals like elderly people or handicapped individuals, this task can be very challenging. A method for opening or closing a door using a motorized device that may assist elderly people or handicapped individuals is described. Reference is now made to FIG. 1A depicting a method for opening a door using a motorized door opening device, optionally in response to a wireless signal, according to some embodiments of the invention.

According to some exemplary embodiments, a motorized door opening device is configured to open a door when an activation signal, for example a wireless signal is received at 100. In some embodiments, when an activation signal is not received by the motorized door opening device, the door can be manually opened by a user, for example by applying a force against the door. In some embodiments when the door is opened manually, the motorized door opening device raises the wheel from the surface. Alternatively, when the door is opened manually, the motorized door opening device is activated and rotates the wheel on the surface. Optionally, when the door is opened manually, the motorized door opening device is not activated. In some embodiments, the wireless signal is transmitted by a user using a remote control, or a handheld device. In some embodiments, the handheld device searches for a motorized door opening device in range by transmitting a wireless signal, for example a Bluetooth signal.

According to some exemplary embodiments, in response to the wireless signal the motorized door opening device lowers at least one wheel to the floor at 102. In some embodiments, the motorized door opening device waits to receive an additional signal from the user, before lowering the at least one wheel to the floor. In some embodiments, when the wheel is lowered, the motorized door opening device adjusts the pressure to be applied by the wheel on the floor.

According to some exemplary embodiments, when the wheel is in contact with the floor after receiving a wireless signal, the motorized door opening device starts to rotate the wheel at 104. In some embodiments, the motorized door opening device is configured to open and to close the door, for example by rotating the wheel in two opposite directions. In some embodiments wheel rotation time is predetermined and is in the range of 1-120 seconds. Alternatively, the wheel is rotated until the door reaches a desired opening degree. In some embodiments, the desired opening degree is predetermined and is in the range of 0.5-180° degrees. Optionally, the wheel is rotated until a signal indicating that the door has reached its desired opening degree is received.

Exemplary Device Operation Process

Figure 1B:
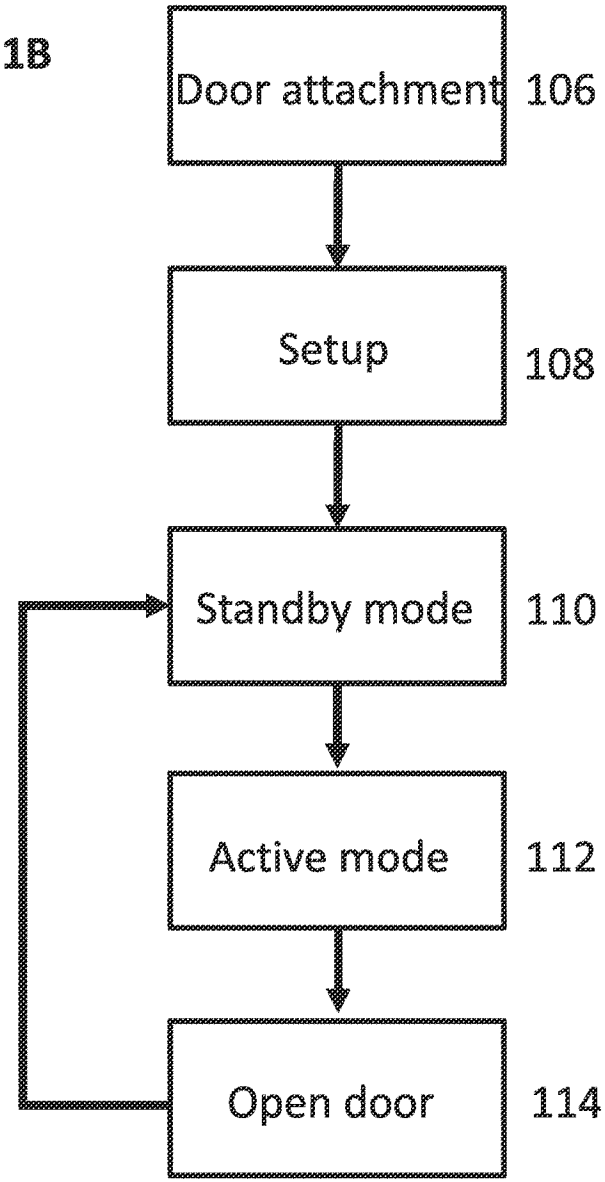
FIG. 1B is a general flow chart of a motorized door opening device activation modes, according to some embodiments of the invention.

Reference is now made to FIG. 1B depicting a method for activation of a motorized door opening device, according to some embodiments of the invention. According to some exemplary embodiments, before initial activation, the motorized door opening device is attached to the bottom of a door at 106. In some embodiments, the motorized door opening device is configured to be attached to the door, for example by threaded means and/or by glue means. In some embodiments, the device attachment position is determined to allow lowering and raising the motorized door opening device wheel to and from the floor. In some embodiments, the attachment position is adjusted and calibrated at setup 108, so when a wheel is lowered by the device, it will be able to make contact with the floor. According to some exemplary embodiments, setup 108 further comprises determining various operation parameters, for example, adjustment of wheel rotation time and/or wheel rotation speed based on the floor type and/or pattern and/or incline. In addition, in some embodiments, setup 108 comprises adjusting the force to be applied by the wheel on the floor. In some embodiments, to do so, the wheel is lowered to the floor until a desired force is applied on the floor. Alternatively, after lowering the wheel to the floor it is rotated to determine a desired friction with the floor. According to some exemplary embodiments, during setup 108 the desired door opening degree and/or the time the door should remain open are determined.

In some embodiments, wheel rotation time and/or wheel rotation speed are adjusted to reach the desired opening degree. In some embodiments, the desired opening degree is marked on the floor by a tag, for example an RFID tag, or a magnetic tag that will be identified by a sensor connected to the motorized door opening device, for example an RFID reader or a magnetic sensor, respectively. In some embodiments, the determined operation parameter values are stored in a memory circuitry of the motorized door opening device.

According to some exemplary embodiments, setup 108 comprises setting a parameter of the door opening device related to a door state, for example to a closed position and/or an open position of the door. In some embodiments, the parameter is adjusted by synchronizing a door state with the position of the device, for example an absolute position or a relative position of the device. In some embodiments, the position of the device is determined by setting the door in a desired state and pressing a button in a handheld device controlling the device or a button on the device itself.

In some embodiments, setup 108 comprises setting a parameter of the door opening device related to the opening direction of the door. In some embodiments, setup 108 comprises adjusting the device to operate with a self-closing door. In some embodiments, when operating with a self-closing door, the wheel is raised or is allowed to rotate freely on the surface to close the door.

According to some exemplary embodiments, setup 108 comprises adjusting the device to operate with a door that is connected to an intercom. In some embodiments, the intercom delivers signals to the door opening device, for example to open or to close the door. In some embodiments, the signals comprise wireless communication signals, for example sound. Alternatively or additionally, the door opening device transmits signals, for example wireless signals to the intercom. In some embodiments, the door opening device transmits signals to the intercom for example to unlock the door. In some embodiments, the door opening device transmits signals to the intercom to activate a speaker and/or a microphone of the intercom. In some embodiments, in setup 108, a pin code or a password of the intercom is inserted to a memory of the door opening device or to a memory of a software program controlling the door opening device.

According to some exemplary embodiments, once setup 108 is completed, the motorized door opening device operation mode is set to a standby mode at 110. In this mode, the device is ready for activation upon receiving an activation signal. In some embodiments, in standby mode, the door can be opened or closed manually without the need to activate the motorized door opening device. According to some exemplary embodiments, in a standby mode the device is configured to reduce the electric power delivered to high-energy consuming components, for example a motor and/or a wheel actuator. According to some exemplary embodiments, during standby mode the device is configured to receive an activation signal via a receiver circuitry of the device and then to shift into an active state. According to some exemplary embodiments, the received activation signal is a wireless signal, for example an infra-red signal or a Bluetooth signal, transmitted from a remote control or a mobile device.

According to some exemplary embodiments, when the motorized door opening device is at standby mode 110, the control circuitry, for example CPU 202 or 236 is in a sleeping mode. In some embodiments, during sleeping mode the control circuitry does not receive electrical power or it receives electrical power for short time periods. In some embodiments, when an activation signal is received, for example activation signal 302, the control circuitry starts to receive electric power.

According to some exemplary embodiments, upon receiving an activation signal, the motorized door opening device operation mode changes from a standby mode to an active mode at 112. In some embodiments, in an active mode, the motorized door opening device operates according to at least one pre-installed operation program. In some embodiments, operation parameter values of the at least one pre-installed operation program were determined in setup 108 and stored in the device memory, for example a memory circuitry 221. According to some exemplary embodiments, in response to an activation signal, the motorized door opening device lowers at least one wheel to the floor until the desired pressure is applied by the wheel on the floor. According to some exemplary embodiments, the desired pressure is determined during setup 108, according to the desired friction level with the floor. In some embodiments, after lowering the wheel to the floor, a motor connected to the wheel starts to rotate the wheel on the floor in a direction that causes the door to open at 114. According to some exemplary embodiments, the door is opened until it reaches a desired opening degree, as determined during setup 108. Alternatively, the door is opened until the motor stops wheel rotation, according to a pre-determined rotation time. Optionally, the door is opened, until a stopping signal is received, for example when an obstacle is found in the door opening trajectory. According to some embodiments, the door is opened until a sensor on the device, for example a magnetic sensor senses a magnetic tag or a magnetic component attached to the floor marking the desired opening degree. In some embodiments, when the magnetic sensor senses the magnetic component attached to the floor, it signals the motorized door opening device to stop the door opening process, by stopping wheel rotation. Alternatively, the door opening process is stopped when an RFID reader component of the motorized door opening device senses an RFID tag attached to the floor. According to some embodiments, the door opening process is stopped either when wheel rotation time reaches a predetermined value, or when a sensor on the motorized door opening device senses a marking on the floor indicating the desired opening degree.

According to some exemplary embodiments, after reaching a desired opening degree, the door stays in an open position for a predetermined time to allow a user to pass through the opened door. Then, in some embodiments the door is closed by the motorized door opening device or by a door closer device attached to the door. According to some exemplary embodiments, after the door is closed, the motorized door opening device operation state changes back to a standby mode. In some embodiments, after the door is closed, the control circuitry changes its operation mode into sleeping mode.

Exemplary Device Components

To allow opening of a door by the motorized door opening device, the device lowers a wheel to the floor in response to an activation signal.

Figure 2A:
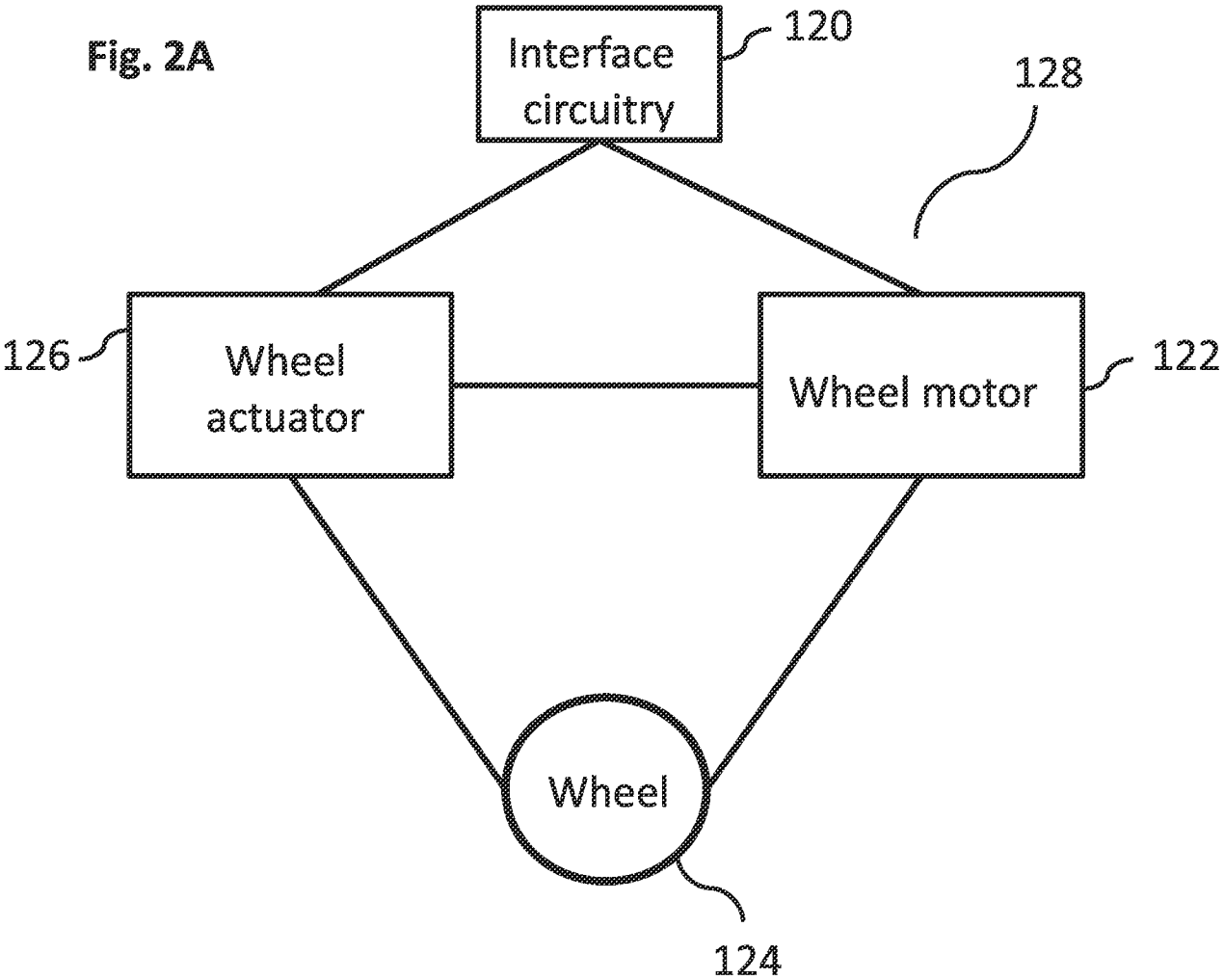
FIG. 2A is a general block diagram of the main components of the device, according to some embodiments of the invention.

Reference is now made to FIG. 2A depicting main components of a motorized door opening device, according to some embodiments of the invention. In some embodiments, the motorized door opening device is activated or changes its operation modes according to received signals. According to some exemplary embodiments, a motorized door opening device 128 comprises an interface circuitry 120 configured to receive signals from remote control devices or handheld devices found in proximity to device 128. In some embodiments, in response to these signals, interface circuitry 120 signals wheel actuator 126, to lower a wheel 124 to a surface. In some embodiments, once wheel 124 is in contact with the surface, interface circuitry 120 signals a wheel motor to rotate wheel 124.

In some embodiments, interface circuitry 120 is configured to receive signals from a control panel mounted on device 128 or positioned adjacent to device 128. Alternatively, the control panel is attached to the door or to the wall adjacent to the door. In some embodiments, the control panel or the control device are connected to interface circuitry 120 by at least one wire or by wireless means. In some embodiments, interface circuitry 120 is configured to receive signals from sensors for example, proximity sensors or touch sensor attached to the door and/or to the wall near the device or on the device. According to some exemplary embodiments, interface circuitry 120 is configured to receive wireless signals, for example Wi-Fi signals and/or Bluetooth signals and/or infra-red signals. In some embodiments, interface circuitry 120 is configured to receive signals from a mobile device, for example cellular phones, and/or wearable computer devices, for example smartwatches.

In some embodiments, when an activation signal is received by interface circuitry 120, device 128 lowers at least one wheel to a surface, for example a floor. According to some exemplary embodiments, motorized door opening device 128 further comprises wheel actuator 126, coupled between the door and at least one wheel 124, and is configured to selectively lower and/or raise wheel 124 in response to a wheel lowering signal from interface circuitry 120. In some embodiments, wheel actuator 126 forces the at least one wheel 124 against a surface with a force greater than gravity. In some embodiments, this force is sufficient to ensure friction between the at least one wheel 124 and the surface to prevent slipping of the at least one wheel 124. In some embodiments, motorized door opening device 128 comprises a circuitry configured to adjust the force applied by the at least one wheel 124 on the surface, according to the at least one wheel 124 slippage.

In some embodiments wheel actuator 126 comprises a linear actuator, for example an electric linear actuator, including an extendible element coupled to the at least one wheel 124 such that change in length of the extendible element causes the wheel to be raised or lowered from the surface. In some embodiments, wheel actuator 126 has a range of motion in the range of 10-70 mm. In some embodiments, wheel actuator 126 has a range of motion in the range of 40-80 mm. In some embodiments, wheel actuator 126 has a range of motion in the range of 30-60 mm, for example 50 mm.

In some embodiments, after the wheel is in contact with the floor, the motorized door opening device rotates the wheel on the floor to close or open the door. According to some exemplary embodiments, motorized door opening device 128 comprises wheel motor 122 configured to rotate the at least one wheel 124 on the floor. In some embodiments, wheel motor 122 is an electric motor and is connected to an electric power supply component of motorized door opening device 128. In some embodiments, the electric motor includes a rotor coupled to rotate the at least one wheel on the floor. In some embodiments, wheel motor 122 is connected to the at least one wheel via a gear component, for example a worm gear. In some embodiments, the motor and/or the gear component are configured to rotate the at least one wheel in two opposite directions to allow both closing and opening of the door. According to some embodiments, wheel motor 122 is configured to apply torque on wheel 124 in the range of 0-10 Nm. In some embodiments, wheel motor 122 is configured to apply torque on wheel 124 in the range of 0-5 Nm, for example 3 Nm.

According to some exemplary embodiments, motorized door opening device 128 is configured to open doors connected to a closing mechanism, for example a door closer device 140. In some embodiments, a closing mechanism comprises a pneumatic closing mechanism, a hydraulic closing mechanism or a spring closing mechanism. In some embodiments, motorized door opening device 128 is configured to apply a force in the range of 0-100 Newton against the door closing mechanism. In some embodiments, motorized door opening device 128 is configured to apply a force in the range of 20-90 Newton against a door closing device, for example 80 Newton. In some embodiments, the desired force to be applied by motorized door opening device 128 on the door is determined during a setup process. Alternatively, the desired force to be applied by motorized door opening device 128 on the door is predetermined, and its predetermined values are stored in a memory circuitry, for example memory circuitry 221, of the device.

Figure 2B:
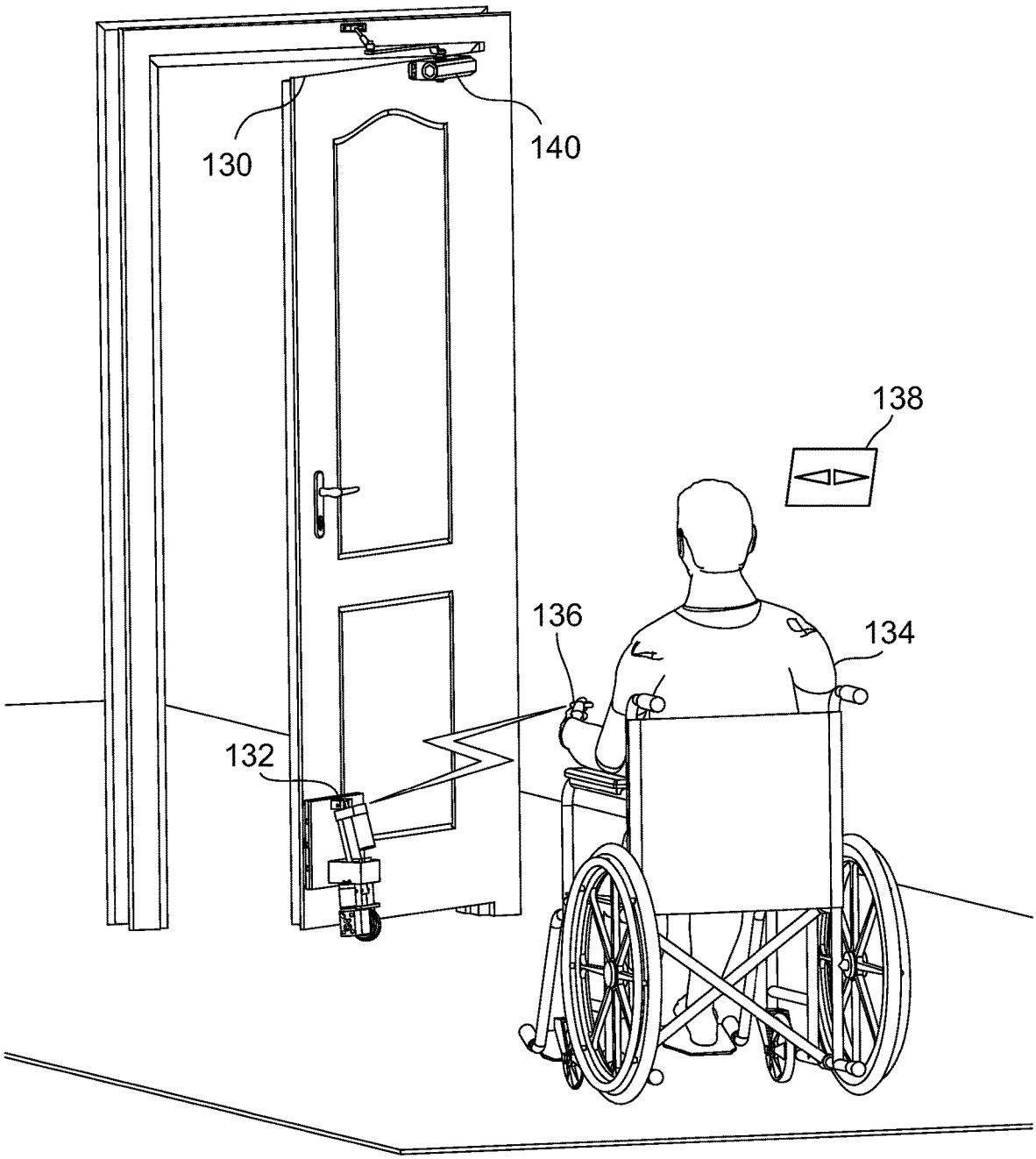
FIG. 2B is a schematic view showing a device attached to a door, and operated by a user, according to some embodiments of the invention.

Reference is now made to FIG. 2B depicting an exemplary usage of a motorized door opening device according to some embodiments of the invention. According to some embodiments, a disabled or a handicapped person who is unable to manually open a door can open the door by activating the motorized door opening device by for example, sending a wireless activation signal from a distance of up to 3 meters, using a remote control or a handheld device. According to some exemplary embodiments, a handicapped user 134 approaches a door 130, and activates a motorized door opening device 132 by transmitting a wireless signal from a remote control 136. Alternatively, handicapped user 134 activates motorized door opening device 132 by transmitting an activation wireless signal from a handheld device using an application program. Optionally, motorized door opening device 132 is activated when handicapped user 134 presses a control panel 138 attached to door 130 or to the wall next to the door.

In some embodiments, when a wireless signal is not received by motorized door opening device 132, door 130 can be manually opened, for example by applying a force against the door. In some embodiments, when a wireless signal is not received by motorized door opening device 132, door 130 is closed by a door closer device 130.

According to some exemplary embodiments, when motorized door opening device 132 is activated, it generates a human detectable alert signal to alert individuals in the vicinity of the motorized door opening device. Alternatively, the alert signal is generated when door 130 moves. In some embodiments, the alert signal is generated by remote control 136 or by a mobile device, for example a handheld device when a signal from motorized door opening device 132 is received by the remote control or mobile device.

According to some exemplary embodiments, to close the door, motorized door opening device 132 rotates the wheel in a direction that will close the door. Alternatively, motorized door opening device 132 raises the wheel from the floor, to allow closing the door by door closer device 140. According to some exemplary embodiments, motorized door opening device 132 transmits log files to a computer device, for example a handheld device. In some embodiments, the computer device for example, a handheld device is configured to display the log files using an application program.

Figure 2C:
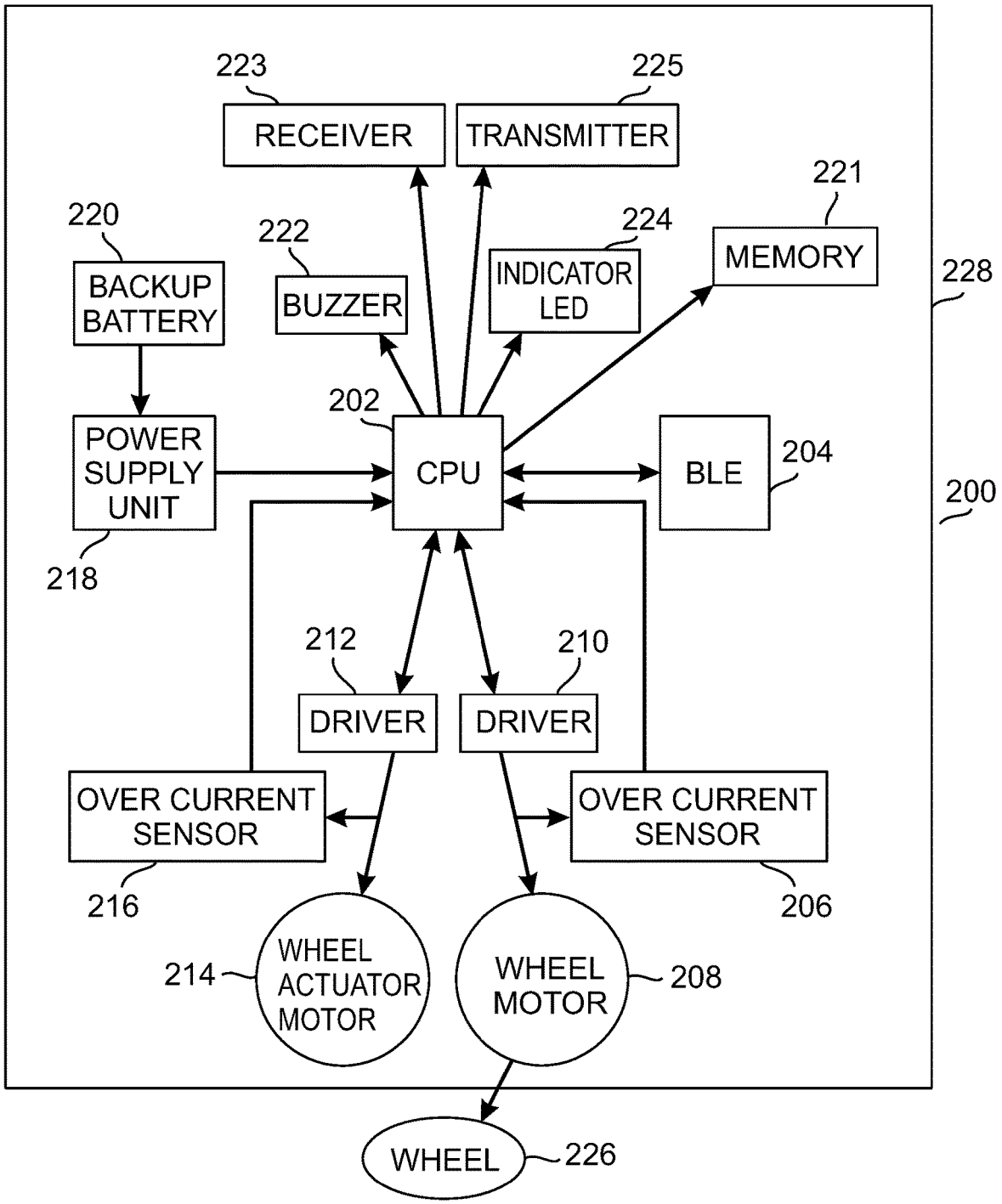
FIG. 2C is a detailed block diagram of the device and its components, according to some embodiments of the invention.
Figure 2D:
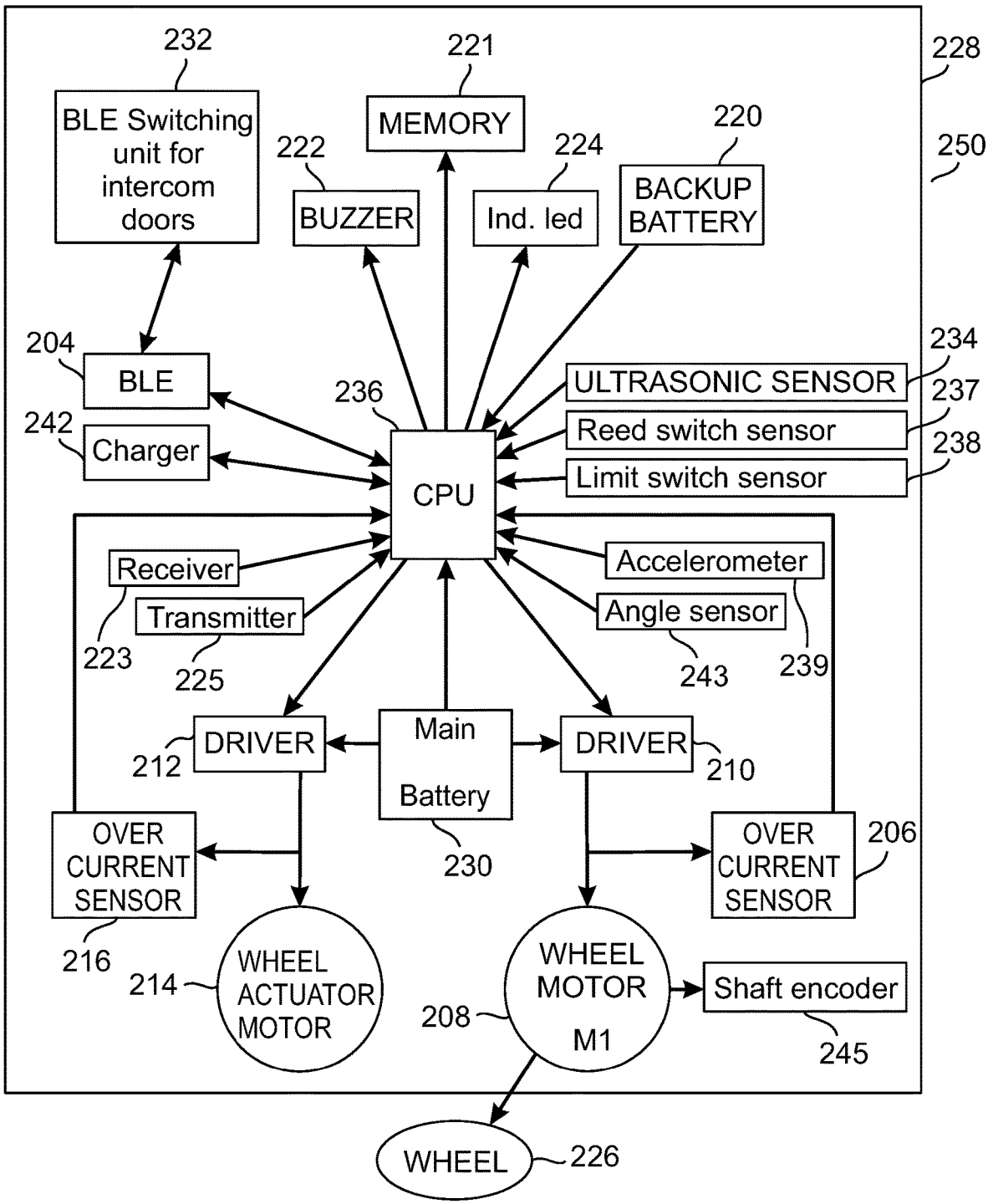
FIG. 2D is an additional detailed block diagram of the device and its components, according to some embodiments of the invention.

Reference is now made to FIG. 2C and FIG. 2D depicting components of a motorized door opening device, according to some embodiments of the invention. According to some embodiments, the motorized door opening device comprises a control circuitry, for example a central processor unit (CPU) 202. In some embodiments, the control circuitry controls the rotation of the wheel on the surface by controlling motor activation state and/or wheel rotation speed. In some embodiments, the control circuitry controls the wheel contact with the floor, for example, by controlling the wheel lowering and/or raising mechanism. In some embodiments, the control circuitry is configured to deliver a wheel lowering signal to a wheel actuator to lower the wheel to the surface. In some embodiments, the control circuitry performs a setup process to determine wheel rotation speed and time. In some embodiments, the setup process comprises determining the desired door opening degree and/or the desired pressure to be applied by the wheel on the surface. According to some embodiments, when an activation signal is received, the control circuitry changes the operation mode of the motorized door opening device from a standby mode to an active mode. In some embodiments, the control circuitry is connected to a memory circuitry, for example memory circuitry 221 configured to store log files and/or device operation programs. In some embodiments, the memory circuitry stores setup process parameter values.

According to some exemplary embodiments, when a wheel lowering signal is not received by wheel actuator, then the door can be manually opened by applying a force against the door by a user.

According to some exemplary embodiments, a motorized door opening device 200 comprising a CPU 202 connected to a wheel actuator motor 214, and/or a wheel motor 208. In some embodiments, CPU 202 is connected to a receiver circuitry 223 which is configured to detect wireless signals, for example Bluetooth low energy (BLE) signals from a handheld device or a control device. In some embodiments, when a wireless signal is received by receiver circuitry 223 and/or by a BLE component 204, receiver circuitry 223 and/or BLE component 204 signals CPU 202 to generate a wheel lowering signal. In some embodiments, the control circuitry, for example CPU 202 transmits the wheel lowering signal to a wheel actuator, for example wheel actuator 126 shown in FIG. 2A. In some embodiments, when a wireless signal is not received by receiver circuitry 223, the door can be manually opened by applying a force against the door by a user, as described in FIG. 1A. In some embodiments, when a wheel lowering signal is not received by the wheel actuator, the door can be manually opened by applying a force against the door by a user. In some embodiments, receiver circuitry 223 is configured to detect signals from sensors connected to the receiver circuitry by wires. In some embodiments, receiver circuitry 223 is configured to detect a wireless signal, for example a wireless activation signal from a distance of up to 3 meters.

According to some exemplary embodiments, when an activation signal is not detected, and/or when the door opening device is not in an active mode, the control circuitry, for example CPU 236 is found in a sleeping mode. In some embodiments, in sleeping mode, the control circuitry does not receive electric power from the power supply. In some embodiments, when an activation signal is received and/or when a BLE component is detected, the control circuitry is activated and starts to receive electric power for longer periods of time.

According to some exemplary embodiments, for example as shown in FIG. 2C, upon the receiving of a wireless signal, for example by BLE component 204, CPU 202 signals wheel actuator motor 214 to raise or lower wheel 226 to a surface. In some embodiments, CPU 202 signals wheel actuator motor 214 to raise or lower wheel 226 via wheel actuator driver 212. According to some exemplary embodiments, wheel actuator comprises at least one current sensor, for example a wheel actuator over current sensor 216 configured to detect electrical current increase in wheel actuator motor 214 and/or wheel actuator driver 212 during the process of raising or lowering wheel 226 to a surface. In some embodiments, the at least one current sensor, for example wheel actuator over current sensor 216 is configured to measure the force applied by wheel 226 on the surface by measuring electrical properties, for example electric current of the wheel actuator. According to some exemplary embodiments, once wheel 226 is in contact with a surface, CPU 202 signals wheel motor 208 to rotate wheel 226 on the surface. In some embodiments, wheel motor 208 is configured to rotate wheel 226 against a door resistance of at least 60 Newton. In some embodiments, wheel motor 208 is configured to generate torque of at least 1.5 Nm. In some embodiments, CPU 202 signals wheel motor 208 to rotate wheel 226 via a wheel motor driver 210. In some embodiments, wheel motor over current sensor 206 is configured to detect an increase in electrical current in wheel motor 208 and/or wheel motor driver 210.

According to some exemplary embodiments, wheel motor 208, for example an electric motor is coupled to wheel actuator and is configured to provide power for lowering wheel 226 to the surface. According to some exemplary embodiments, wheel motor 208, for example an electric wheel motor delivers torque to wheel 226 through a gear component, for example a worm gear connected to wheel 226 by a drive shaft. In some embodiments, the gear component is configured to change the torque delivered to wheel 226 by wheel motor 208.

According to some exemplary embodiments, motorized door opening device 200 further comprises a power supply unit 218, configured to supply electrical power to door opening device 200 components, for example CPU 202. According to some embodiments, at least one backup battery 220 is connected to power supply unit 218 and/or to CPU 202, and is configured to supply electrical power to motorized door opening device 200 when power supply unit 218 is discharged or removed. According to some exemplary embodiments, power supply unit 218 and/or backup battery 220 are rechargeable polymer based batteries, for example Lithium ion batteries configured to be easily replaced and/or charged.

According to some exemplary embodiments, for example as shown in FIG. 2D, motorized door opening device 250 comprises a backup battery, for example backup battery 220, configured to supply electric power to CPU 236 when main battery 230 is discharged. Alternatively, backup battery 220 is configured to supply electric power to CPU 236 when main battery 230 is not functioning. In some embodiments, power supply unit 218 comprises main battery 230. According to some exemplary embodiments, for example a shown in FIG. 2D, main battery 230 is configured to supply electrical power to wheel actuator driver 212 and/or to wheel motor driver 210. In some embodiments, main battery 230 is configured to supply electric power to wheel actuator motor 214 and/or to wheel motor 208. In some embodiments, main battery 230 is connected to wheel actuator driver 212 and/or to wheel motor driver 210. In some embodiments, main battery 230 is connected to wheel actuator motor 214 and/or to wheel motor 208. According to some exemplary embodiments, main battery 230 is connected to CPU 236 and is configured to supply electrical power to at least one additional component of motorized door opening device 250. According to some exemplary embodiments, main battery 230 and/or backup battery 220 are rechargeable polymer based batteries, for example Lithium ion batteries configured to be charged by an external charger, for example electric charger.

According to some exemplary embodiments, for example as shown in FIG. 2D, when main battery 230 and/or backup battery 220 is discharged, an electric charger 242 is connected to CPU 236 to charge the empty batteries. Alternatively, electric charger 242 is configured to charge main battery 230 and/or backup battery 220 by connecting directly to the discharged battery.

In some embodiments, when the motorized door opening device is activated, a human detectable alert signal is transmitted by an alert circuitry of the motorized door opening device. In some embodiments, the alert circuitry generates an alert signal to be transmitted by a light-emitting alert component, and/or a sound producing alert component. According to some exemplary embodiments, motorized door opening device 200 further comprises at least one buzzer 222 and/or at least one LED indicator 224. According to some exemplary embodiments, buzzer 222 and/or LED indicator are configured to generate sound and/or emit light respectively in response to a signal from CPU 202, for example, when motorized door opening device 200 operation mode shifts to an active mode and/or when wheel 226 rotates and/or when door opens. According to some exemplary embodiments, LED indicator 224 is configured to emit light when motorized door opening device 200 is in a standby mode and/or when motorized door opening device 200 is in an active mode. In some embodiments, LED indicator 224 is configured to emit light when the door is moved by the device.

According to some embodiments, motorized door opening device 200 transmits an alert signal to a remote control or a mobile device held by the device user.

According to some exemplary embodiments, motorized door opening device 200 comprises a transmitter circuitry 225 connected to CPU 202 and configured to transmit log files and/or setup parameters to a computer and/or a mobile device, for example a handheld device. In some embodiments, transmitter circuitry 225 is configured to transmit data by infra-red and/or radio frequency waves. Alternatively, transmitter circuitry is configured to transmit data via wires coupled between motorized door opening device 200 and a remote computer or a mobile device. According to some embodiments, receiver circuitry 223 is configured to receive operation programs for remote reprogramming of motorized door opening device 200.

According to some exemplary embodiments, motorized door opening device 200 comprises a housing 228 configured to attach motorized door opening device 200 to a door by connection members, for example threaded means and/or glue means. In some embodiments, housing 228 further comprises a recess fitted to allow raising or lowering wheel 226 to the floor from the housing.

According to some exemplary embodiments, a motorized door opening device comprises at least one sensor on its outer surface, configured to detect objects near the device, for example when the motorized door opening device opens a door. According to some exemplary embodiments, for example as shown in FIG. 2D, motorized door opening device 250 comprises at least one ultrasonic sensor 234 under the control of CPU 236. In some embodiments, ultrasonic sensor 234 is configured to detect an object in the door opening trajectory, for example an individual, by transmitting sound waves to an area near the motorized door opening device. Alternatively, when the door makes contact with an object during the door opening process, the electric current in wheel motor 208 and/or wheel driver 210 increases, and the increase is sensed by a wheel motor over current sensor 206. In some embodiments, when the electrical current increases, wheel motor over current sensor 206 signals the control circuitry, for example CPU 202 to stop the door opening process. In some embodiments, wheel motor over current sensor 206 signals the control circuitry, for example CPU 202 to stop wheel 226 rotation.

According to some embodiments, motorized door opening device comprises a sensor configured to sense when the door reaches a desired opening degree by sensing a sticker or a component attached to the floor surface at the desired opening degree. In some embodiments, when the sensor senses the sticker or the floor attachment, it signals the motorized door opening device control circuitry to stop wheel rotation. According to some exemplary embodiments, for example as shown in FIG. 2D, motorized door opening device 250 comprises a magnetic sensor, for example a Reed switch sensor 237 connected to motorized door opening device control circuitry, for example CPU 236. In some embodiments, Reed switch sensor 237 is configured to signal CPU 236 when the door reaches a desired opening degree by sensing a magnetic tag attached to the floor. According to some embodiments, the magnetic tag is attached to the floor during device setup, for example setup 108 in FIG. 1B.

According to some exemplary embodiments, a motorized door opening device comprises an RFID reader configured to sense when the door has reached a desired opening degree, by sensing an RFID tag attached to the floor. Alternatively, the RFID reader is configured to sense when the door has reached a desired opening degree, by sensing an RFID tag attached to a wall adjacent to the door.

According to some embodiments, a motorized door opening device comprises a sensor for indicating when a liner actuator extendible element of the motorized door opening device is partly or fully extended. Alternatively, the sensor indicates when the linear actuator piston is partly or fully retracted.

According to some exemplary embodiments, for example, as shown in FIG. 2D, motorized door opening device 250 comprises a Limit switch sensor 238, connected to CPU 236. In some embodiments, Limit switch sensor 238 is configured to indicate when an extending element of the wheel linear actuator, for example a piston is fully extended or fully retracted.

According to some exemplary embodiments, as shown for example in FIG. 2D, motorized door opening device 250 comprises BLE component 204 configured to transmit a wireless signal, for example a Bluetooth signal to a BLE switching unit 232 placed on a door frame configured to release a door lock to allow its opening. Alternatively, a transmitter component of the motorized door opening device, for example transmitter 225 is configured to transmit a wireless signal to BLE switching unit 232 or to any wireless communication responsive unit to release the door lock. In some embodiments, transmitter 225 delivers signals to an intercom, for example to unlock the door. In some embodiments, to be connected with the intercom, the transmitter 225 sends a pin code or a password stored in memory 221, to the intercom. According to some exemplary embodiments, when BLE switching unit 232 receives a signal from motorized door opening device 250, it signals an electric strike to release a locked mechanical latch or a bolt to allow door opening.

According to some exemplary embodiments, as shown for example in FIG. 2D, motorized door opening device 250 comprises a receiver, for example receiver 223 for receiving signals from a remote control or a handheld device. Alternatively or additionally, the receiver 223 receives signals from an intercom device. In some embodiments, the intercom delivers signals to activate the door opening device. In some embodiments, the intercom delivers signals to open or to close the door. In some embodiments, a user activates the door opening device using a software program installed in the remote control or in the handheld device, for example a cellular device. In some embodiments, the user signals the motorized door opening device to lower the wheel and/or to rotate the wheel. In some embodiments, when the motorized door opening device is not in use or is not in an active state, the wheel is up and does not contact the floor. In some embodiments, when the wheel is up and/or when the door opening device is not active, the door is opened and/or closed manually.

According to some exemplary embodiments, the motorized door opening device 250 comprises a shaft encoder, for example shaft encoder 245. In some embodiments, the shaft encoder 245 is connected to the wheel or the wheel motor and is used for example, to monitor the rotation of the wheel 226 or the wheel motor 208. In some embodiments, the CPU 236, measures the rotation time and/or speed of the wheel or the wheel motor based on signals received from the shaft encoder 245. In some embodiments, the CPU 236 determines whether the measured rotation speed is a desired rotation speed, optionally by comparing the measured speed to speed values stored in memory 221.

According to some exemplary embodiments, the motorized door opening device 250 comprises a door state sensor, for example to determine the absolute or the relative position of the door. In some embodiments, the door state sensor is an angle sensor, for example angle sensor 243. In some embodiments, angle sensor 243 comprises a gyroscope or an optical sensor for determining the absolute or the relative position of the door opening device and the door.

According to some exemplary embodiments, the door opening device comprises an accelerometer 239, for example to sense the door movement. In some embodiments, by sensing the door movement and the movement duration the door opening device determines the opening or closing angle of the door. Optionally, based on sensing the door movement and the movement duration, the door opening device determines the remaining time needed to reach a desired door state.

In some embodiments, if the door is at a desired open state, for example as detected by the angle sensor and/or by the accelerometer, the motorized door opening device prevents the closure of the door for a predetermined time or until a user passes through the opening. In some embodiments, if the door remains closed after an activation signal is delivered by the CPU 236, then an alert signal is transmitted to the user.

Exemplary Wheel and Motor States

Once the motorized door opening device is attached to a door, it allows a user to open or close the door either manually or using the motorized door opening device.

Figure 3:
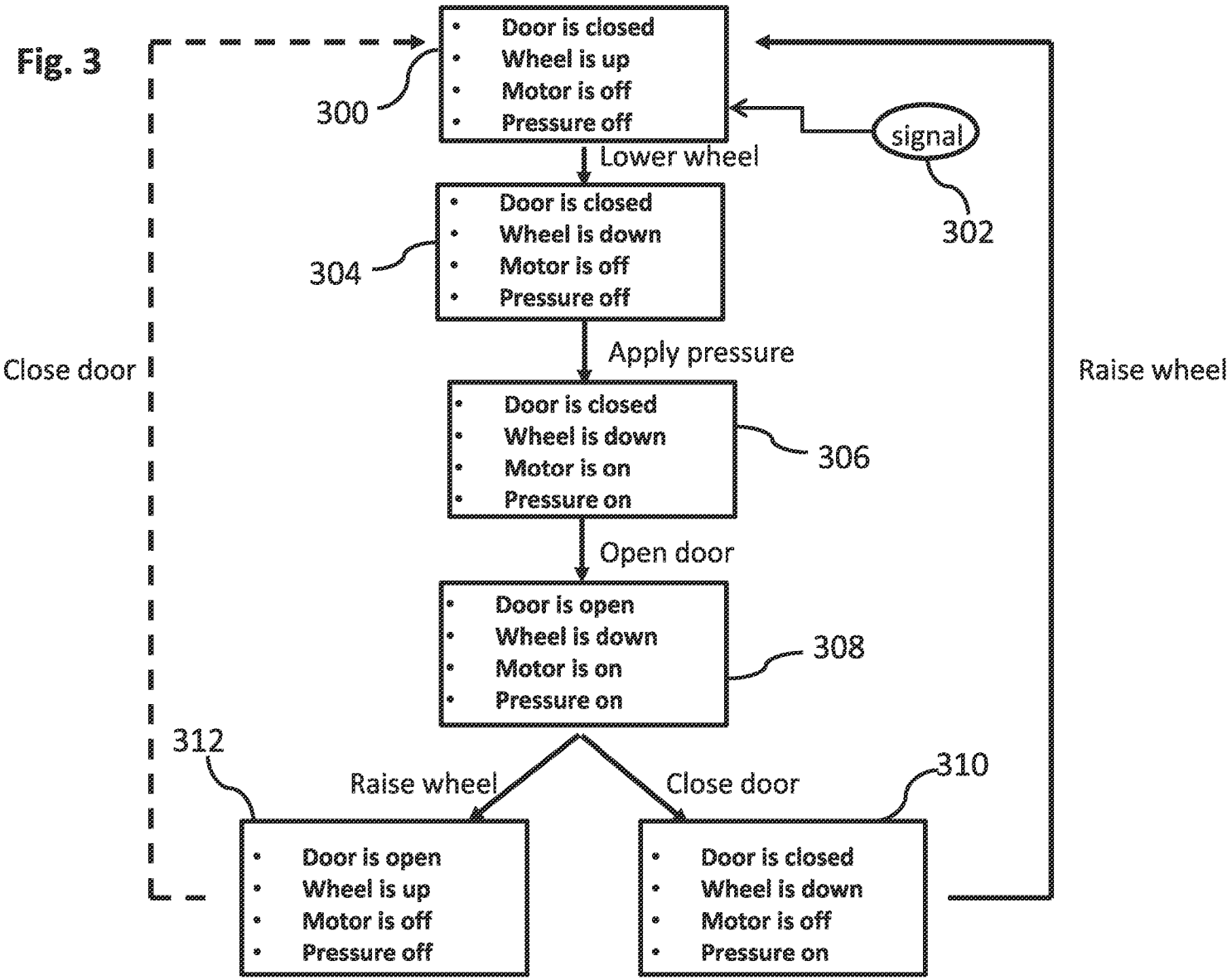
FIG. 3 is a state diagram describing various states of system components, according to some embodiments of the invention.

Reference is now made to FIG. 3 depicting wheel and motor states during a process of opening and closing a door by rolling a wheel of the device on a surface, according to some embodiments of the invention. According to some exemplary embodiments, when a door is closed at state 300, the motorized door opening device is in a standby mode, and is ready to receive an activation signal 302. In some embodiments, when the door is closed at state 300, the control circuitry is in a sleeping mode. In some embodiments, when the door is closed at state 300, the wheel is not in contact with the surface and the wheel motor which is used to rotate the wheel is not active.

According to some embodiments, when activation signal 302 is received, the motorized door opening device lowers the wheel to the surface at state 304. In some embodiments, when the wheel is lowered, the wheel motor does not rotate the wheel.

In some embodiments, the wheel is lowered until a desired pressure is applied on the surface at state 306. In some embodiments, the desired pressure is determined based on the surface type and/or surface incline. In some embodiments the desired pressure is determined during a setup step, for example at setup 108, as shown in FIG. 1B, prior to the initial activation of the motorized door opening device. In some embodiments, the desired pressure applied at step 306 is adjusted after the wheel is in contact with the surface. In some embodiments, after the wheel is in contact with the surface, the motorized door opening device activates the wheel rotor at state 306.

According to some exemplary embodiments, once the wheel applies the desired pressure on the surface, the motor is activated and rotates the wheel on the surface, which causes the door to open at state 308. According to some exemplary embodiments, when the door reaches a desired opening degree, the motor stops rotating the wheel and wheel brakes are applied to keep the door in an open state for a predetermined time. Alternatively, the motor applies the exact force on the door, to prevent its movement. Optionally, wheel motor is locked to prevent closure of the door by a door closer device.

According to some exemplary embodiments, to close the door, the motor starts to rotate the wheel in an opposite direction to the direction used to open the door. In some embodiments, when the door is closed at state 310, the wheel is still in contact with the surface, and the motor is not active. In some embodiments, after the door was closed at state 310, the motorized door opening device raises the wheel from the surface, and now the system return to state 300.

In some embodiments, the wheel is raised from the surface to allow a door closer device to close the door at state 312. Optionally, the motor is deactivated while the wheel is still in contact with the floor, to allow a door closer device to close the door.

Exemplary Wheel Engagement Process

Figure 4A:
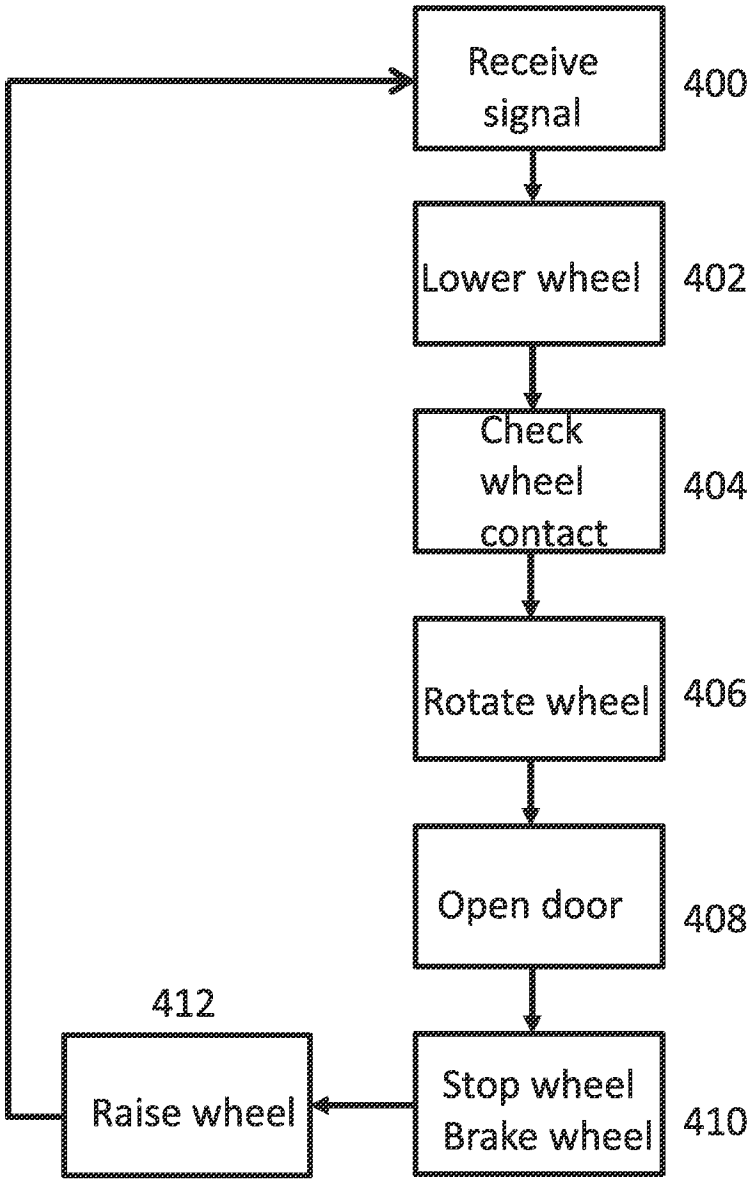
FIG. 4A is a general flow chart of a wheel engagement process, according to some embodiments of the invention.

According to some embodiments, a motorized door opening device is configured to lower or raise a wheel from a surface by a wheel actuator coupled to the wheel. Reference is now made to FIG. 4A depicting a general wheel engagement process, according to some embodiments of the invention. According to some exemplary embodiments, upon receiving a signal at 400, for example wireless signal 302, the motorized door opening device is configured to lower at least one wheel to a surface at 402. In some embodiments this can be achieved by signaling a wheel actuator, for example wheel actuator 126, that can be an electric piston or an electric linear actuator to push at least one wheel to the surface.

According to some exemplary embodiments, to make sure that the wheel is in contact with the surface, a contact check is performed by measuring changes in various electric parameters of the electric actuator or the electric piston at 404, for example changes in current or voltage. In some embodiments, when at least one wheel is in contact with the surface, a motor connected to the wheel, for example wheel motor 122, through a gear component or directly, starts to rotate the wheel on the surface at 406. In some embodiments, when the wheel rotates on the surface, it causes the door, for example door 130, to rotate around a pivot axis until it reaches a desired opening degree at 408. In some embodiments, when the desired opening degree is reached, the motor stops wheel rotation and wheel brakes are applied to keep the door open for a desired time, for example for at least 1 second at 410. Alternatively, wheel motor is locked to prevent the door from moving. According to some exemplary embodiments, to close the door, the motorized door opening device raises the wheel from the surface, to allow a door closer device, for example door closer device 140, to close the door at 412. Alternatively, brakes are released and the motor rotates the wheel in an opposite direction to close the door.

According some exemplary embodiments, when the door reaches a desired opening degree at 408, wheel motor is locked at 410 to prevent door from closing by a door closer device, for a predetermined time. In some embodiments, the wheel motor locking time is determined during a setup process, for example setup 108. In some embodiments, the device releases the motor locks upon receiving a signal. In some embodiments, when wheel motor locks are released, the device rotates the wheel to close the door or until a desired opening degree is reached. Alternatively, the device raises the wheel at 412, to allow manual door closing. In some embodiments, the wheel is raised after the door is closed.

Figure 4B:
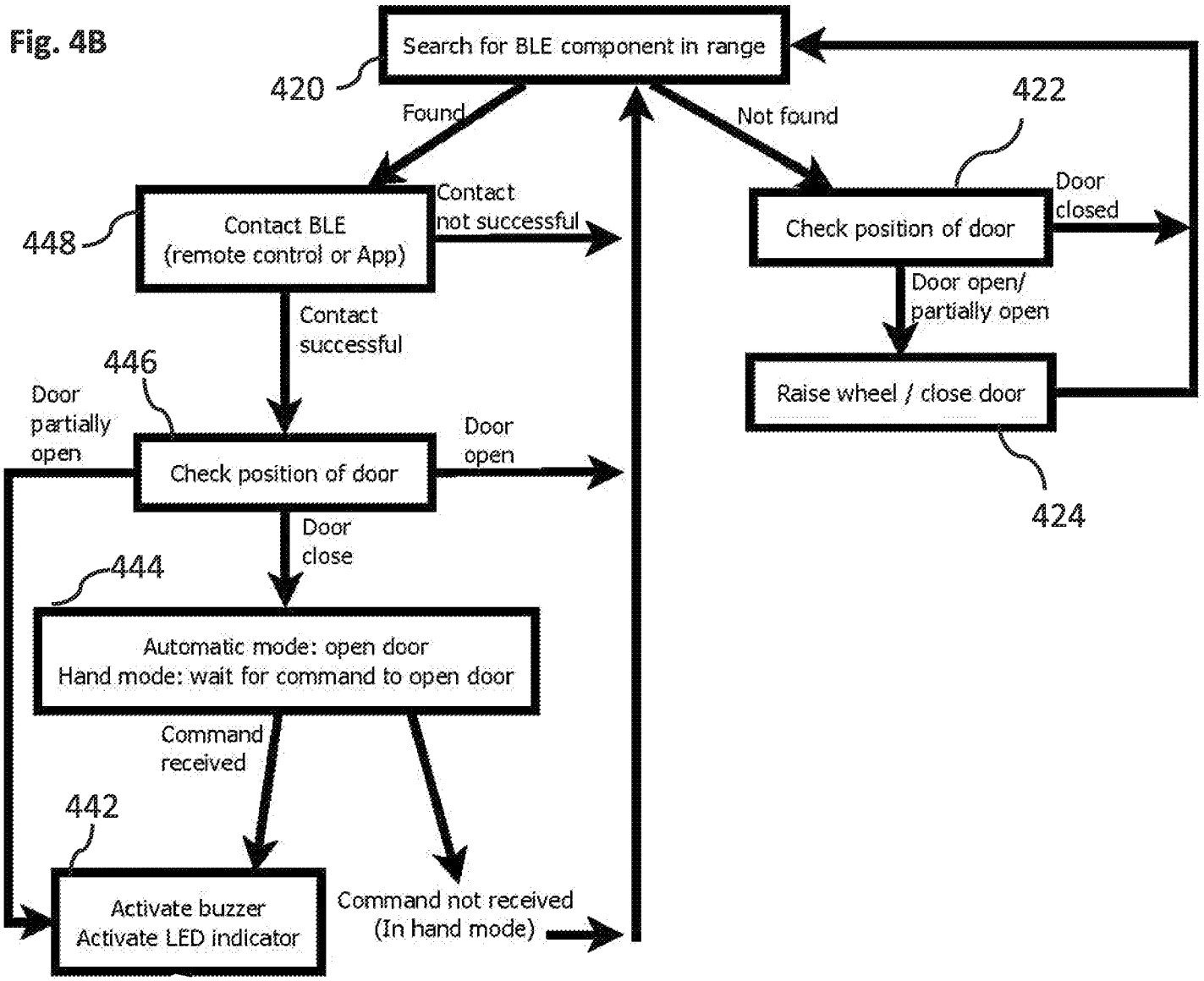
FIGS. 4B and 4C are detailed flow charts of a wheel engagement process, according to some embodiments of the invention.
Figure 4C:
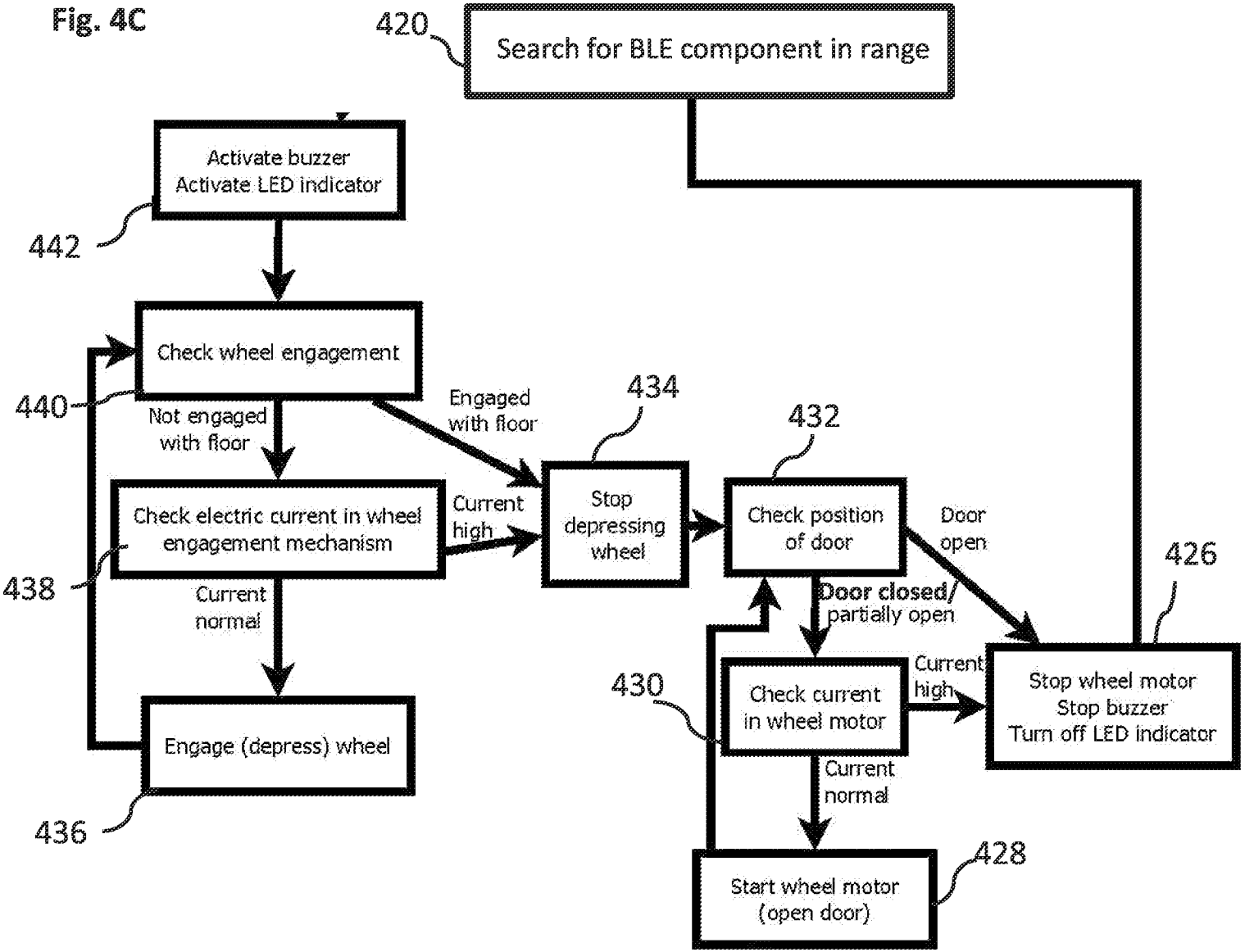

Reference is now made to FIGS. 4B and 4C depicting a detailed wheel engagement process according to some embodiments of the invention. According to some embodiments, a motorized door opening device, for example motorized door opening devices 200 or 250 are configured to allow manual opening of a door when they are not active, for example when the wheel is raised from the floor. According to some exemplary embodiments, a motorized door opening device is searching for a signal, for example a BLE signal, transmitted by a BLE component at 420. Alternatively, the motorized door opening device is searching for any wireless signal, for example an infra-red signal. Optionally, the motorized door opening device is searching for signals delivered by sensors connected to the device by wired means or wireless. According to some exemplary embodiments, the motorized door opening device is searching for signal transmitting devices in range, for example a handheld device or remote control 136. In some embodiments, if a BLE component is not detected, the motorized door opening device checks the door position by at least one sensor of the device, for example an accelerometer 239 or an angle sensor 243, and/or using at least one sensor placed on the door frame at 422. Optionally, the motorized door opening device determines door position using sensors placed on the surface. In some embodiments, the door position can be determined by analyzing wheel rotation, for example number of rotations and/or time of wheel rotation. In some embodiments, the number of wheel rotations and/or time of wheel rotation required to reach a desired opening degree are determined during a setup process, for example setup 108. According to some exemplary embodiments, in case the door is closed, the motorized door opening device will continue to search for a BLE component, or other wireless components in range. Alternatively, if the door is closed, then the motorized door opening device continues to search for an activation signal, for example signal 302. In some embodiments, if the door is open or partially open, then the motorized door opening device signals a wheel actuator, for example wheel actuator 514 to raise the wheel to allow closing of the door by a door closer device, for example door closer device 140, at 424. Alternatively, the motorized door opening device signals a motor of the device, for example wheel motor 208, to rotate the wheel in a direction that will allow closing of the door. Optionally, the motorized door opening device deactivates the motor, to allow closing the door while wheel, for example wheel 226, is still in contact with the surface.

According to some exemplary embodiments, if a BLE component, for example remote control 134 or a handheld device are detected at 420, the motorized door opening device tries to establish a connection with the BLE component at 448. In some embodiments, if the connection attempt is not successful, then the motorized door opening device returns to search for a BLE component at 420. However, in some embodiments, if a connection with the BLE component is established, the motorized door opening device checks the position of the door, for example door 130, at 446. According to some exemplary embodiments, if the door is already open, then the motorized door opening device returns to search for a BLE component and/or a wireless signal at 420. In some embodiments, if the door is partly open, then the motorized door opening device transmits a human detectable alert signal by activating a light emitting alert component, and/or a sound producing alert component at 442. Alternatively, motorized door opening device signals a handheld device and/or a remote control, for example remote control 136, located near the motorized door opening device to generate a human detectable alert signal. In some embodiments, light emitting alert component comprises a LED indicator, for example LED indicator 224. In some embodiments, sound producing alert component comprises a buzzer, for example buzzer 222. According to some exemplary embodiments, if the door is closed, then the motorized door opening device checks whether it operates in a manual mode or in an automatic mode at 444. According to some exemplary embodiments, in an automatic mode, the motorized door opening device lowers the wheel and opens the door when a remote control or a handheld device transmit a signal to the motorized door opening device from a distance of 0-4 meters, for example a distance of 0-2 meters, or 0.5-3.5 meters. In some embodiments, in an automatic mode, the motorized door opening device opens the door when a remote control and/or a handheld device transmit a signal to the motorized door opening device from a distance of 2 meters from the motorized door opening device. In some embodiments, the motorized door opening device opens the door when a remote control or a handheld device comprising a BLE component are in a distance of 0-3 meters from the motorized door opening device, for example 1-2 meters. According to some embodiments, in a manual mode, once a handheld device is in range and transmits an initial signal, the motorized door opening device waits for an additional signal from the user, for example by activating an application program on the handheld device, or by pressing a control panel, for example control panel 138.

According to some exemplary embodiments, after the activation of the buzzer and/or the LED indicator in 442, as shown in FIG. 4C, the motorized door opening device checks wheel engagement status at 440. In some embodiments, the wheel engagement status is determined by measuring the pressure applied by the wheel, for example wheel 226, on the surface. Alternatively, the wheel engagement status is determined by measuring different electrical properties, for example current and/or voltage parameters, of the wheel actuator. Alternatively, the pressure applied by the wheel is measured by sensors placed on the wheel and/or on the wheel actuator.

In some embodiments, if the wheel is already engaged with the surface, then the motorized door opening device stops depressing the wheel against the surface at 434. If the wheel is not engaged with a surface, then the motorized door opening device checks electric current values in the wheel actuator at 438. Alternatively, if the wheel is not engaged with a surface, then the motorized door opening device checks predetermined parameters and/or relevant operation programs stored within the device, on a memory circuitry, for example memory circuitry 221. In some embodiments, in case that the measured current is in a pre-determined desired range or has a pre-determined desired value, wheel depressing mechanism is activated to engage or to depress the wheel with the floor at 436. In some embodiments, once wheel actuator is activated, the motorized door opening device returns to check wheel engagement status at 440, as described above. In some embodiments, if the current measured at 438 is higher than a desired predetermined value or is not within a desired pre-determined range of current values, then the device stops depressing the wheel against the surface at 434 by deactivating the wheel actuator. Alternatively, to stop depressing the wheel, the wheel actuator raises the wheel from the surface.

According to some exemplary embodiments, after stopping the wheel engagement process at 434, the motorized door opening device checks the door position at 432, as described previously at 446. In some embodiments, if the door is closed or partially open, then the electrical current of the wheel motor is measured at 430. In some embodiments, if the wheel motor electrical current value is in a desired range or has a desired value, then the wheel motor is activated to allow rotation of the wheel and opening of the door at 428. In some embodiments, if the motor electrical current is not in a desired range or is higher than a desired current value, then the motorized door opening device stops wheel rotation and stops transmitting an alert signal, by turning off, for example a buzzer and/or a LED indicator at 426. In some embodiments, after stopping the wheel motor at 426, the door opening device returns to search for an activation signal and/or a BLE component in range at 420.

According to some exemplary embodiments, after activating the wheel motor at 428, the motorized door opening device returns and checks the door position at 432. In some embodiments, if checking the door position at 432 indicates that the door is now open and/or it reached a desired opening degree, then the motorized door opening device stops the wheel motor from rotating the wheel at 426. In some embodiments, after stopping the wheel motor, the motorized door opening device stops transmitting an alert signal by deactivating the sound and/or light producing alert components, for example the buzzer alarm, and/or the LED indicator at 426. According to some exemplary embodiments, after stopping the motor at 426, the motorized door opening device returns to search for a BLE component and/or a wireless signal in 420, as described previously.

Exemplary Device

According to some exemplary embodiments, a motorized door opening device comprises a wheel actuator to lower or raise a wheel from a surface and a motor to rotate the wheel on the surface, to allow opening or closing of a door.

Reference is now made to FIGS. 5A-5D depicting a motorized door opening device, according to some embodiments of the invention. According to some exemplary embodiments, motorized door opening device 500 comprises wheel 502 coupled to a wheel actuator, for example linear actuator 514 which is configured to lower or to raise wheel 502 from a surface by extending or retracting an extendible element, for example, a piston coupled to wheel 502. Alternatively, linear actuator 514 is coupled to wheel sliders 512, or to other components connected to wheel 502.

In some embodiments linear actuator 514 comprises an extendible element coupled to wheel 502 or wheel sliders 512. In some embodiments, when the extendible element changes its length, it causes wheel 502 to be lowered or raised from a surface. In some embodiments linear actuator 514 is an electric linear actuator configured to lower wheel 502 or wheel sliders 512 in response to a wheel lowering signal generated by a control circuitry, for example control circuitry of the door opening device.

According to some exemplary embodiments, linear actuator 514 is configured to lower wheel 502 by applying a force in the range of 0-200 Newton against the surface. Optionally, linear actuator 514 is configured to apply a force in the range of 0-100 Newton, or in the range of 100-200 Newton.

According to some exemplary embodiments, motorized door opening device 500 comprises wheel motor 510, for example an electric motor configured to rotate wheel 502. In some embodiments, wheel motor 510 is configured to rotate wheel 502 in two opposite directions, to allow both opening and closing of a door. In some embodiments wheel motor 510 delivers torque to wheel 502 via gear component 508, for example a worm gear component. In some embodiments, gear component 508 is configured to adjust the toque delivered to wheel 502. In some embodiments, wheel 502 is connected to motor gear assembly 509 which comprises wheel motor 510 and gear component 508.

According to some exemplary embodiments, wheel motor 510 comprises a rotor configured to rotate and cause rotation of wheel 502. In some embodiments, torque is delivered to wheel 502 via drive shaft 506. In some embodiments, drive shaft 506 is coupled between wheel 502 and wheel motor 510 or gear component 508. In some embodiments, drive shaft 506 passes through motor bracket 504, which is connected to motor gear assembly 509. In some embodiments, motor bracket 504 includes drive shaft bore 524, fitted to allow drive shaft 506 to pass through the motor bracket.

According to some embodiments, when the wheel is lowered or raised from the surface it moves along a fixed path and/or in a fixed angle relative to the surface. In some embodiments, wheel sliders 512 are configured to pass through sliders channels 528 within sliders bracket 516, which allows wheel 502 to be lowered or raised along a fixed path. In some embodiments, sliders channels 528 limit the horizontal movement of wheel sliders 512, and allow their substantially vertical movement. In some embodiments, the substantially vertical movement of wheel sliders 512 is determined by the angle of sliders channels 528 relative to the surface. According to some exemplary embodiments, sliders bracket 516 further comprising linear actuator channel 530 fitted to allow linear actuator 514 and/or its extendible element to slide along a fixed path, and/or in a desired fixed angle relative to the surface. According to some embodiments, linear actuator 514 can be fixed in a desired angle relative to the door. In some embodiments, fixing linear actuator 514 and/or wheel sliders 512 in a desired angle allows raising and lowering of the wheel in a distance from the door and to avoid interference by different door attachments. According to some exemplary embodiments, linear actuator 514 is connected to base plate 518 via base plate hinge 532. In some embodiments, this connection allows adjusting the positioning angle of linear actuator 514 to a desired angle relative to base plate 518. According to some exemplary embodiments, sliders bracket 516 is positioned substantially perpendicular to base plate 518 and is configured to fix the position of wheel sliders 512 in a desired distance from the door.

According to some exemplary embodiments, the motorized door opening device is configured to be attached to a door. In some embodiments, the way motorized door opening device is attached to the door, allows its easy installation and/or removal, for example for repair or adjustments. According to some exemplary embodiments, motorized door opening device 500 comprises a door attachment member 520, configured to be attached to a door. In some embodiments, door attachment member is attached to the door, for example door 130 by glue means and/or threaded means. In some embodiments, base plate 518 is attached to door attachment member 520 by sliding base plate 518 along door attachment locking rails 522 of door attachment member 520. In some embodiments, motorized door opening device 500 is removed from the door by sliding base plate 518 along the door attachment locking rails 522 in an opposite direction to the attachment direction, as described above.

Figures 5C, 5D:
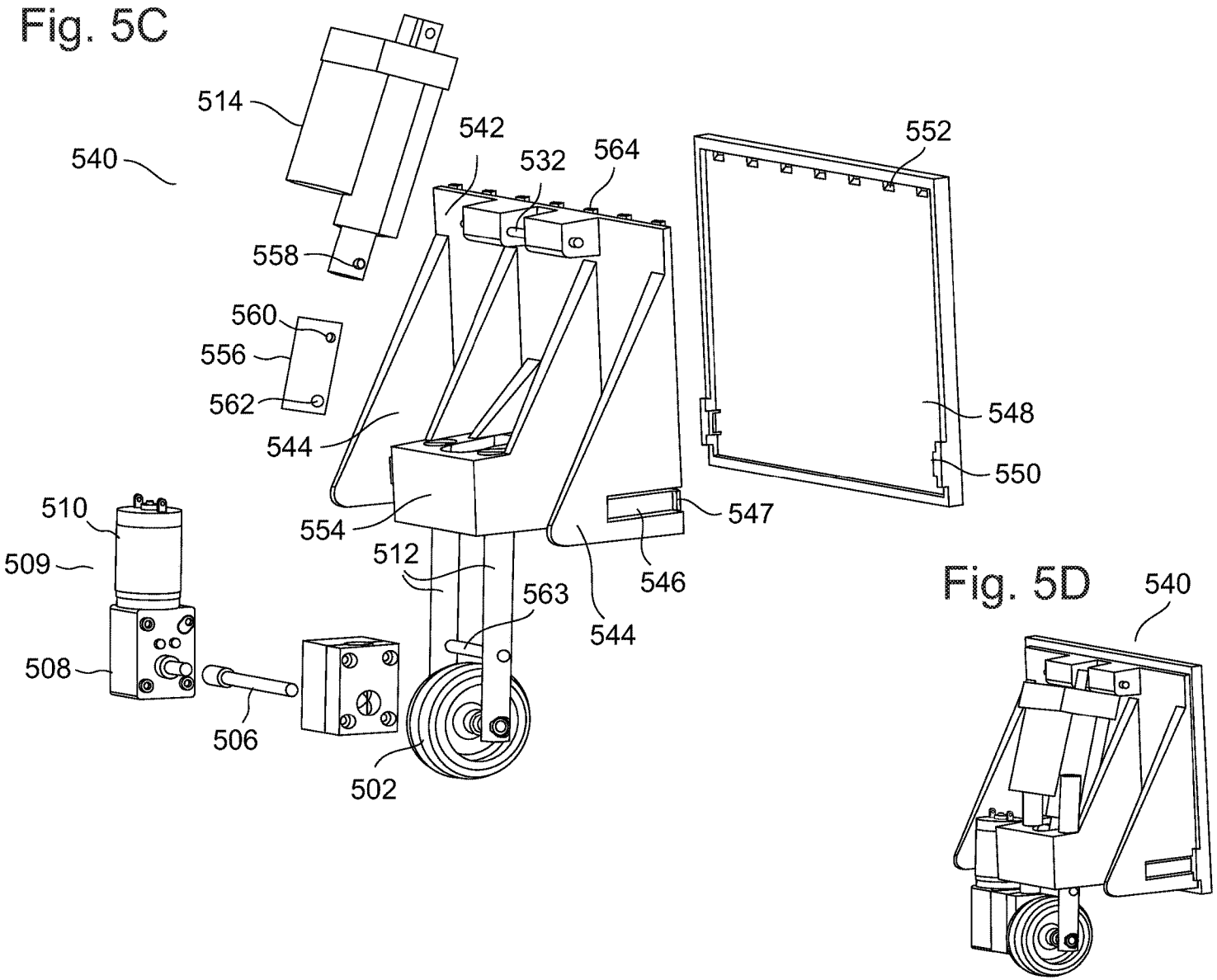
FIG. 5C is an additional exploded view of a motorized door opening device, according to some embodiments of the invention.
FIG. 5D is a schematic view of an assembled device, for example as shown in FIG. 5C, according to some embodiments of the invention.

According to some embodiments, the linear actuator is coupled to the wheel or to the wheel sliders via a connecting member. According to some exemplary embodiments, for example as shown in FIG. 5C, linear actuator 514 is connected to wheel sliders 512 via connecting member 556. In some embodiments, connecting member comprises an upper bore 560 and a lower bore 562. In some embodiments, upper bore 560 is connected to linear actuator 514 via a liner actuator connecting pin 558. In some embodiments, lower bore 562 is connected to wheel sliders 512 via wheel sliders connecting shaft 563 which is configured to pass through lower bore 562 of connecting member 556. According to some exemplary embodiments, linear actuator 514 is connected to base plate 542 via base plate hinge 532, as described above.

According to some exemplary embodiments, for example as shown in FIG. 5C, wheel sliders 512 are connected to wheel 502, and are configured to pass through channels within sliders bracket 554, when linear actuator 514 raises or lowers wheel 502. In some embodiments, sliders bracket 554 is connected to base plate 542. In some embodiments, base plate 542 comprises at least one side plate 544.

According to some exemplary embodiments, base plate 542 is connected to door connecting member 548 via at least one connecting member. In some embodiments, side plate 544 comprises at least one snap fit 546. In some embodiments, snap fit 546 comprises bulge 547 fitted to be placed within slot 550 of door connecting member 548 to form an interference lock assembly. In some embodiments, base plate 542 comprises at least one protuberance 564. In some embodiments, base plate 542 is attached to door connecting member 548 by interconnecting protuberance 564 with at least one protuberance 552. Optionally, base plate 542 is attached to door connecting member 548 via both snap fit 546 and protuberance 564.

Figure 5F:
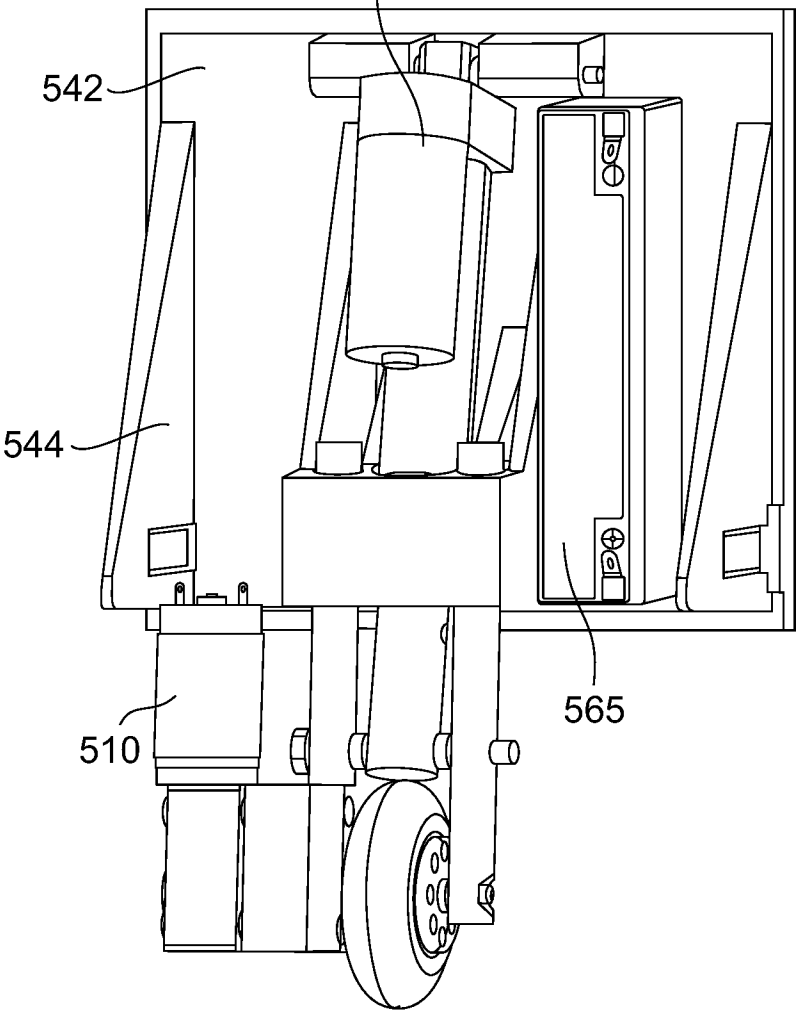
FIG. 5F is a schematic view showing a power supply component connected to a door opening device, according to some embodiments of the invention.
Figure 5E:
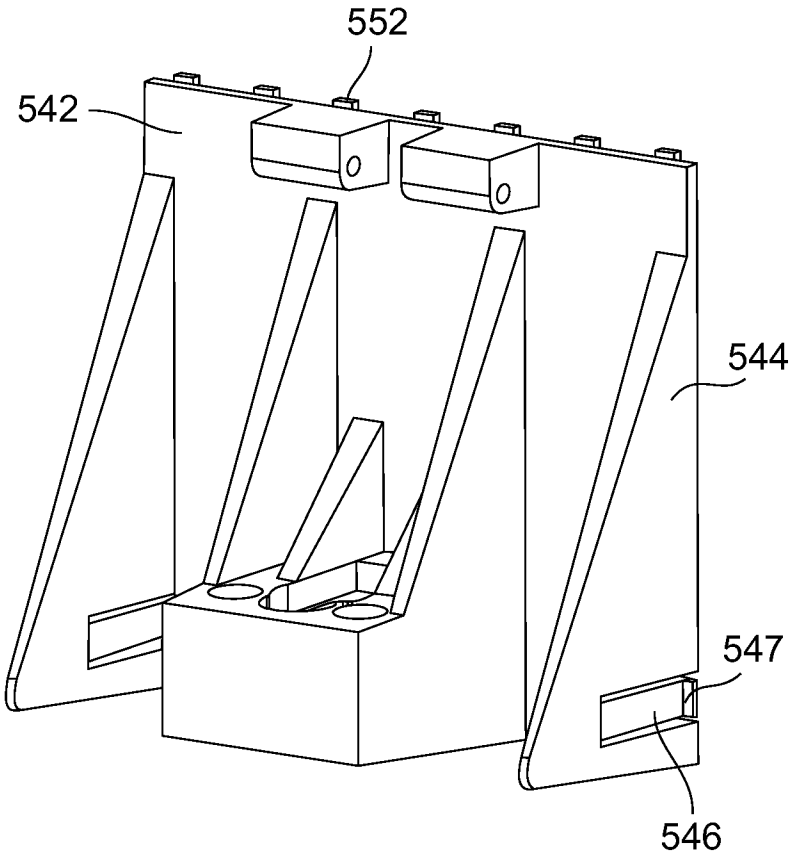
FIG. 5E is a schematic view describing attachment members involved in attaching a motorized door opening device base plate to a door attachment member, for example as shown in FIG. 5C, according to some embodiments of the invention.

Reference is now made to FIG. 5E depicting connection members of a motorized door opening device, according to some embodiments of the invention. According to some exemplary embodiments, a motorized door opening device comprises connecting members configured to attach the motorized door opening device to a door or to a door attachment member. According to some exemplary embodiments, base plate 542 comprises at least one connecting member, for example at least one snap fit 546 further comprising bulge 547 configured to be fitted within slot 550, as shown in FIG. 5C in a door or in door connecting member 548. Alternatively, door connecting member 548 comprises at least on snap fit component with a bulge configured to be fitted within a slot of base plate 542. In some embodiments, at least one protuberance 552, as shown in FIGS. 5C and 5E, is configured to hold base plate 542 upper edge in a fixed position. According to some embodiments, a motorized door opening device is attached to a door or to a door attachment member by at least two connecting members placed in two opposite locations on the door attachment member and/or on the base plate coupled to the linear actuator. In some embodiments, base plate 542 comprises at least one snap fit 546 to attach the lower parts of base plate 542 and door connecting member 548, and at least one additional connecting member, for example protuberance 552 to hold together the two upper parts of base plate 542 and door connecting member 548. Alternatively, at least one protuberance 552 holds together the lower parts of base plate 542 and door connecting member 548, and at least one snap fit 546 is configured to attach the upper parts of base plate 542 and door connecting member 548.

In an example of use, base plate 542 is first connected to door connecting member 548 by placing the upper edge of base plate 542 under protuberance 552. In some embodiments, the connection to protuberance 552 serves as a pivot which allows moving the lower end of base plate 542 until snap fit 546 is pushed towards side plate 544 and enters slot 550 in door connecting member 548. In some embodiments, after snap fit 546 has entered slot 550, it moves back to its original position and forms an interference lock assembly, which locks bulge 547 within slot 550. In some embodiments, to remove base plate 542 from door connecting member 548, snap fit 546 and bulge 547 need to be pushed towards side plate 544, until bulge 547 is released from slot 550. Then the lower part of base plate 542 can be separated from door connecting member 548, and when it is pulled down, the upper edge of base plate 542 can be released from protuberance 552.

Reference is now made to FIG. 5F depicting a power supply of a motorized door opening device, according to some embodiments of the invention. According to some exemplary embodiments, motorized door opening device 540 comprises an electric power supply, for example battery 565 configured to supply power to door opening device 540 electrical components, for example linear actuator 514 and/or motor 510. In some embodiments battery 565 is coupled to base plate 542. In some embodiments battery 565 is connected to motorized door opening device 540 via connection members configured to allow attachment and detachment of battery 565 from the device. In some embodiments battery 565 comprises an electric rechargeable battery, for example a lithium-ion battery. In some embodiments, battery 565 is configured to be charged by an electric charger, for example an electric charger 242. In some embodiments motorized door opening device 540 transmits a human detectable alert signal when battery 565 is discharged and/or partially discharged.

Exemplary Wheel Engagement Mechanism

According to some embodiments, the motorized door opening device lowers at least one wheel to the floor until a desired contact pressure is applied by the wheel on the floor. In some embodiments, the wheel is lowered to the floor until a desired friction with the floor is achieved. In some embodiments, during the wheel depressing process, the wheel is lowered to the floor in a right angle, or in a different angle relative to the floor.

Figure 6B:
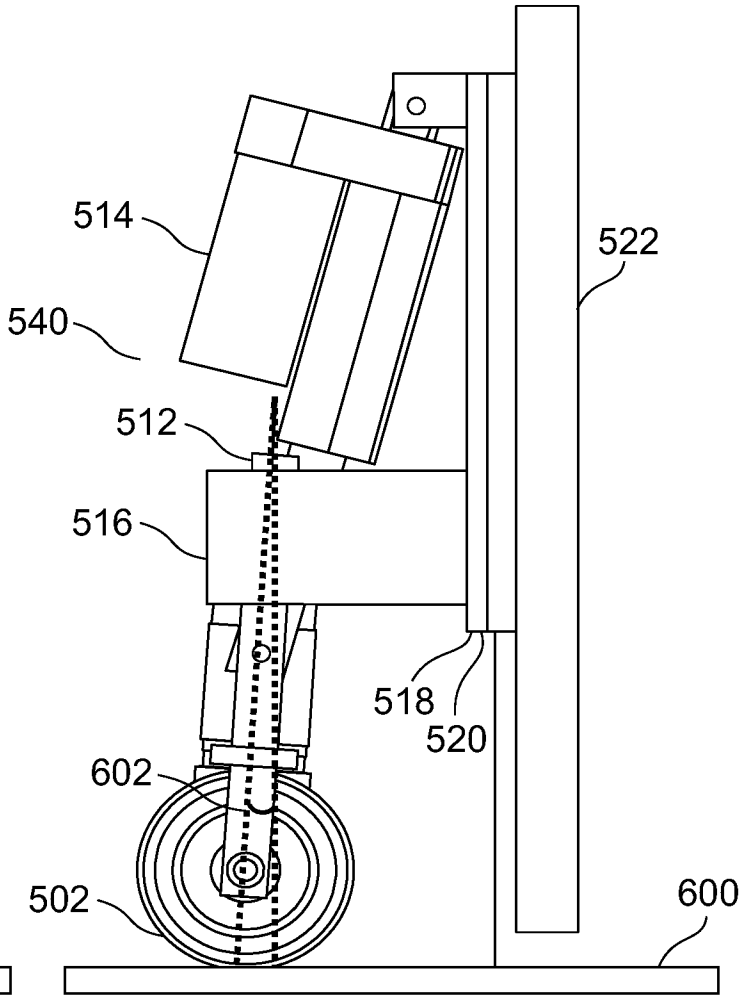
FIG. 6B is a schematic view showing a wheel actuator apparatus (wheel is down), according to some embodiments of the invention.
Figure 6A:
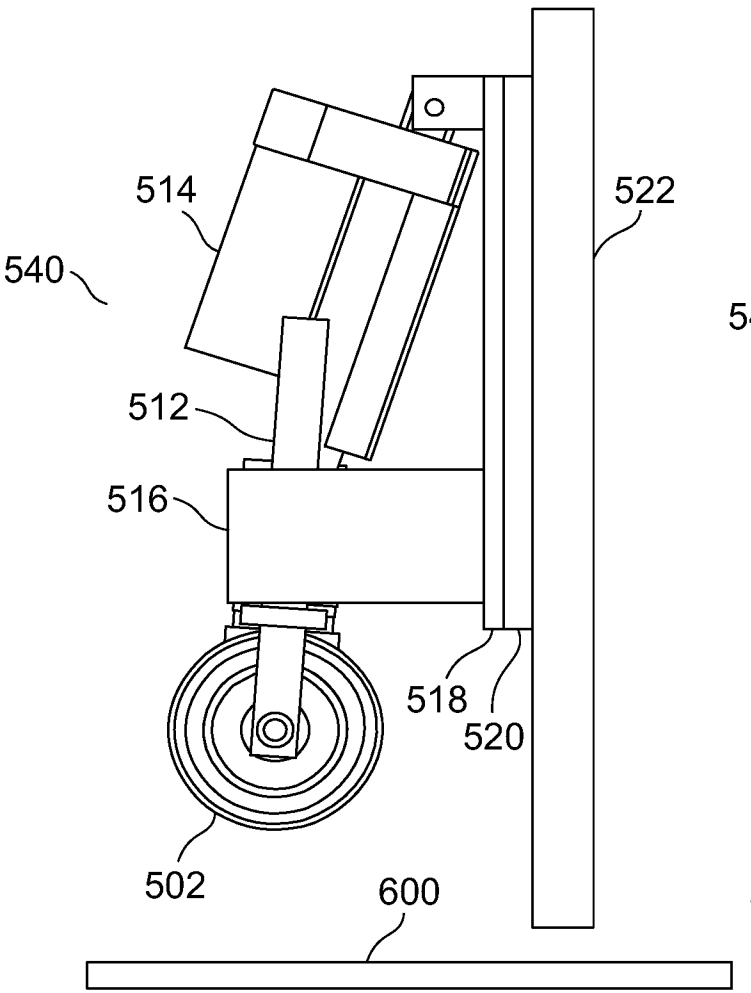
FIG. 6A is a schematic view showing a wheel actuator apparatus (wheel is up), according to some embodiments of the invention.

Reference is now made to FIGS. 6A and 6B depicting a wheel actuator when the wheel is in contact with the floor (FIG. 6A) and when the wheel is raised from the floor (FIG. 6B), according to some embodiments of the invention. According to some exemplary embodiments, linear actuator 514 is connected to wheel sliders 512 or wheel 502 and is configured to raise or lower wheel sliders 512 or wheel 502 in response to a signal. According to some exemplary embodiments, wheel sliders 512 are positioned in a desired angle 602 relative to door 522. In some embodiments, the desired angle 602 is determined by channels, for example sliders channels 528, within sliders bracket 516. In some embodiments the sliders channels are fitted to allow a substantially vertical movement of wheel sliders 512 in desired angle 602. According to some exemplary embodiments the desired angle 602 is in the range of 0-45°, for example 0-20° or 20-45°.

According to some embodiments, wheel actuator, for example linear actuator 514 pushes wheel 502, and the different components connected to it, for example a wheel motor and/or a gear component to the floor, in response to a signal. According to some exemplary embodiments, as seen in FIG. 6B, when a signal to lower wheel 502 is received, linear actuator 514 pushes wheel sliders 512 and wheel 502 towards floor 600. Alternatively, linear actuator 514 pushes wheel sliders 512, wheel 502 and other components connected to wheel 502, for example wheel motor, gear component and motor bracket towards floor 600. According to some embodiments, linear actuator 514 stops depressing wheel 502 to floor 600, when a desired pressure is applied on the floor, and/or when the desired friction with floor 600 is achieved. In some embodiments, the pressure applied by wheel 502 on floor 600 can be determined based on changes in the electrical properties of linear actuator 514, for example changes in current and/or voltage. In some embodiments, linear actuator 514 is configured to push wheel 502 and/or wheel sliders 512 along a predetermined distance based on floor 600 type and/or floor 600 surface cover. Alternatively, linear actuator 514 is configured to push wheel 502 and/or wheel sliders 512 along a predetermined distance based on the attachment height of motorized door opening device 540 on door 522, relative to floor 600.

Figure 6C:
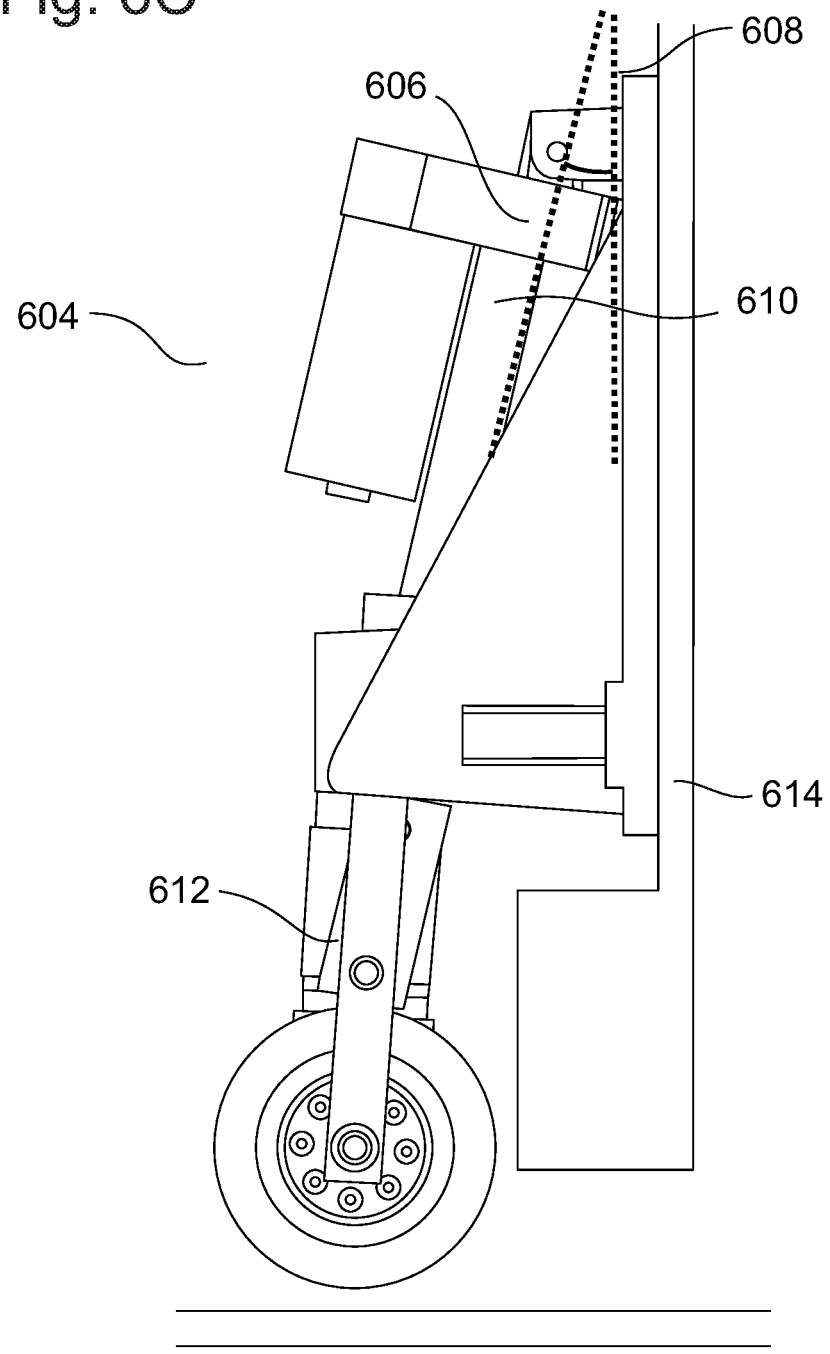
FIG. 6C is a schematic view showing the angle between a base plate and a linear actuator connected to it, according to some embodiments of the invention.

Reference is now made to FIG. 6C depicting a linear actuator of a motorized door opening device placed in a desired angle relative to the door, according to some embodiments of the invention. According to some exemplary embodiments, the motorized door opening device is attached to a door in a way that causes the linear actuator of the door opening device to be positioned at a desired angle and/or distance relative to the door. According to some exemplary embodiments, motorized door opening device 604 is attached to a door 614. In some embodiments, motorized door opening device 604 comprises linear actuator 606 configured to lower or raise a wheel to a floor by extending or retracting an extendible element 612. In some embodiments, linear actuator is connected to base plate 608 of motorized door opening device 604 via a base plate hinge, as described in FIGS. 5A and 5C. In some embodiments, the hinge serves as a pivot axis that allows to position linear actuator 606 in a desired angle relative to base plate 608 and/or door 614. In some embodiments, the desired angle is changed when extending element 612 is extended or retracted. In some embodiments, desired angle 610 is in the range of 1-30°, for example 1-20°. In some embodiments, desired angle 610 between linear actuator 606 and base plate 608 is in the range of 10-30°, for example 14° when linear actuator 606 extendible element 612 is in the most retracted position. In some embodiments, desired angle 610 between linear actuator 606 and base plate 608 is in the range of 5-15°, for example 12°, when extendible element 612 is fully extended.

Exemplary Device Attached to a Door

According to some embodiments, the motorized door opening device is configured to be attached to the bottom part of a pivotally supported door. In some embodiments, after attachment of the motorized door opening device, it can be activated and move the door by rotating a wheel on the floor until a desired opening degree is reached. In some embodiments, to close the door, the motorized door opening device can rotate the wheel on the floor in the opposite direction, or to raise the wheel from the floor to allow a door closer device to close the door.

Figures 7A, 7B:
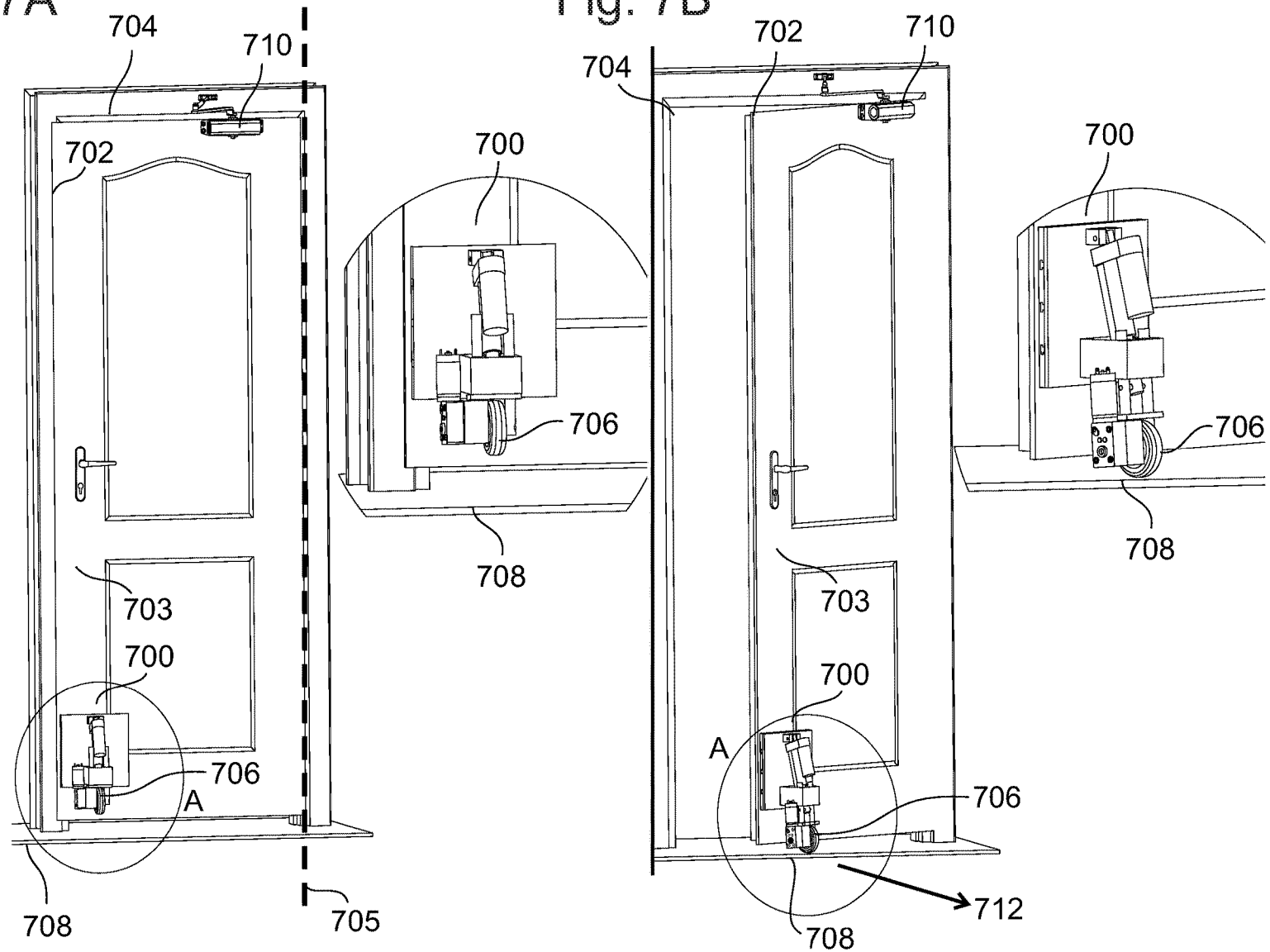
FIG. 7A is a schematic view showing a device attached to a closed door, according to some embodiments of the invention.
FIG. 7B is a schematic view showing a device attached to an open door, according to some embodiments of the invention.

Reference is now made to FIGS. 7A and 7B depicting a motorized door opening device attached to a door, when the door is closed (FIG. 7A) and when the door is open (FIG. 7B), according to some embodiments of the invention. According to some embodiments, the motorized door opening device is attached to the door in a position that will allow lowering a wheel to the floor. In some embodiments the door opening device will be attached to the door in a position that will allow applying the minimal torque necessary to open the door. According to some exemplary embodiments, motorized door opening device 700 is configured to be attached to the bottom part of pivotally supported door 702, in a close proximity to floor 708. In some embodiments, motorized door opening device is attached to door leaf 703 in a position which is distant from door opening axis 705 to allow minimal application of torque, to open pivotally supported door 702. According to some exemplary embodiments, pivotally supported door 702 includes a door closer device 710, configure to close the door.

According to some exemplary embodiments, when pivotally supported door 702 is closed, as seen in FIG. 7A and motorized door opening device 700 is in a standby mode, wheel 706 is not in contact with floor 708. In this position, pivotally supported door 702 can be opened manually without the need to activate motorized door opening device 700. In some embodiments, this allows to reduce the wearing of motorized door opening device 700 parts, for example wheel 702.

According to some exemplary embodiments, when motorized door opening device 700 receives an activation signal, for example a wireless signal, wheel 706 is lowered until it is in contact with floor 708. In some embodiments, after it was lowered to the floor, motorized door opening device 700 rotates wheel 706 in direction 712 to open pivotally supported door 702, as seen in FIG. 7B. According to some exemplary embodiments, when pivotally supported door 702 is opened and reaches a desired opening degree, wheel 706 rotation is stopped. In some embodiments, motorized door opening device 700 activates brakes to stop wheel 706 rotations, and to prevent pivotally supported door 702 from closing. In some embodiments, motorized door opening device 700 stops pivotally supported door 702 from closing, by applying a force in direction 712 that is equal to the force applied by door closer device 710. Optionally, motorized door opening device 700 stops pivotally supported door 702 from closing by locking the wheel motor, which prevents wheel rotation. According to some exemplary embodiments, motorized door opening device 700 keeps pivotally supported door 702 open for a predetermined time period. In some embodiments, motorized door opening device 700 keeps pivotally supported door 702 open for at least 1 second. Alternatively, motorized door opening device 700 keeps pivotally supported door 702 open until an activation signal is not detected and/or until a device transmitting an activation signal is not detected by motorized door opening device 700.

According to some exemplary embodiments, to close pivotally supported door 702, motorized door opening device 700 raises wheel 706 and allows door closer device 710 to push and close the door. Alternatively, motorized door opening device 700 rotates wheel 706 on floor 708 in an opposite direction to direction 712, until pivotally supported door 702 is in contact with door frame 704, or until a desired opening degree is reached.

According to some exemplary embodiments, when wheel 706 is raised, motorized door opening device 700 returns to a standby mode, to minimize power consumption. Alternatively, motorized door opening device 700 returns to a standby mode after door 702 is closed. In some embodiments, the control circuitry of motorized door opening device 700 returns to a sleeping mode after door 702 is closed.

Figure 7C:
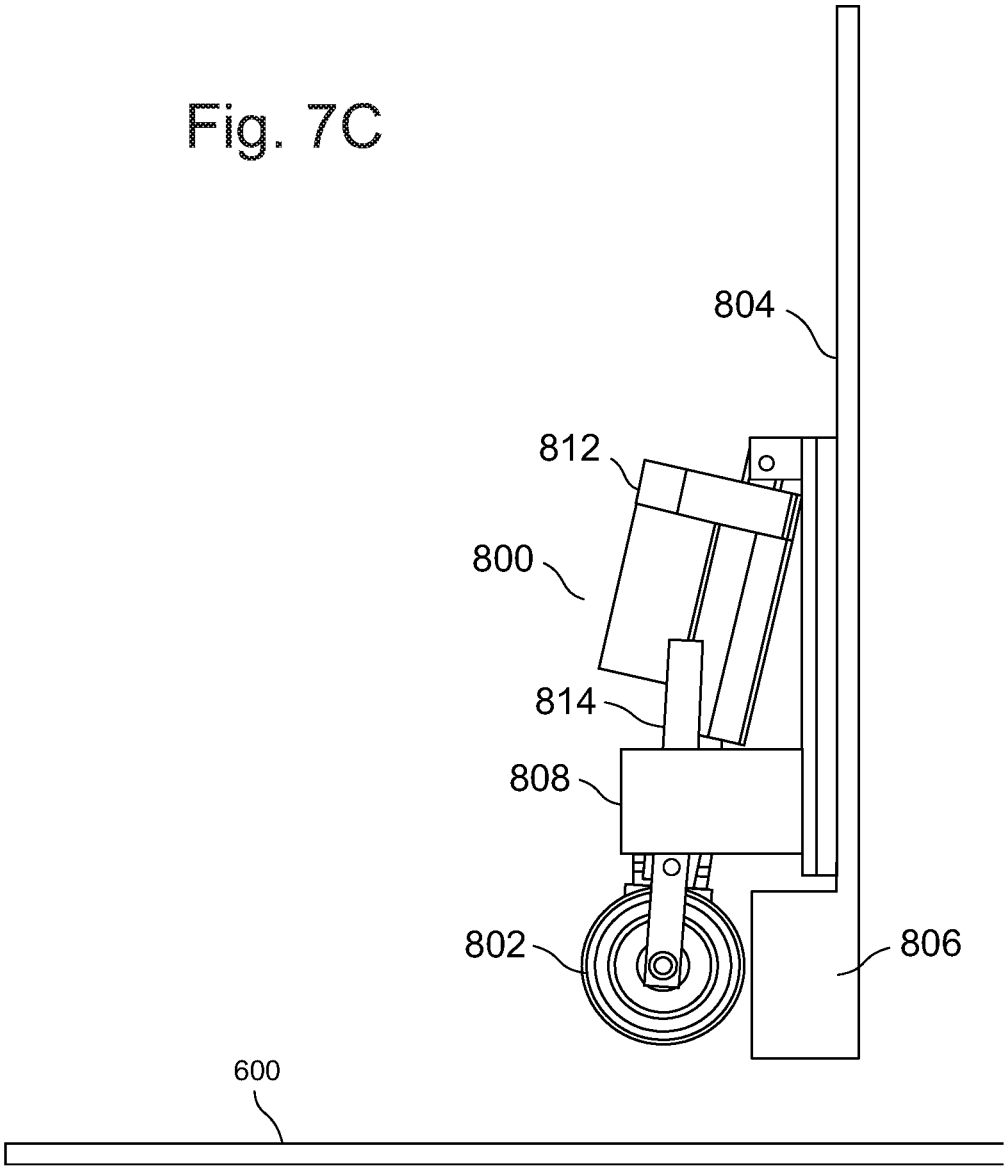
FIG. 7C is a schematic view showing a device attached to a door with an aluminum profile, according to some embodiments of the invention.

According to some embodiments, a door may include various attachments on its surface, for example supplementary profiles and/or decorative attachments. These attachments might interfere with the wheel depressing process. In some embodiments, to avoid this interference, the wheel of the motorized door opening device is lowered to the floor in a distance from the door and its attachments. Reference now is made to FIG. 7C depicting a motorized door opening device attached to a door that includes attachments on its surface, for example aluminum profile attachments, according to some embodiments of the invention. According to some exemplary embodiments, motorized door opening device 800 is configured to be attached to door 804 comprising an aluminum profile 806 connected to the bottom part of the door. According to some exemplary embodiments, motorized door opening device 800 comprises a spacer, for example slider bracket 808 which holds linear actuator 812 and/or wheel sliders 814 in a distance from door 804. In some embodiments, when linear actuator 812 pushes wheel 802 to floor 810, wheel 802 is positioned in a desired distance from aluminum profile 806. In some embodiments, the spacer, for example slider bracket 808 allows lowering or raising wheel 802 in a distance of at least 1 mm from door 804.

According to some exemplary embodiments, when wheel 802 is in contact with floor 810, it is positioned in a distance of 1-80 mm from door 804, for example 1-55 mm or 50-80 mm. In some embodiments, wheel 802 is positioned at a distance of 50 mm from door 804. According to some exemplary embodiments, motorized door opening device 800 is configured to lower wheel 802 to floor 810 from a height of 1-200 mm, for example 1-50 or 50-200 mm. In some embodiments, motorized door opening device 800 is configured to lower wheel 802 to floor 810 from a height of 50 mm.

Exemplary Controlling Program

According to some exemplary embodiments, the door opening device is controlled and operated using a remote control or a handheld device, as previously described. In some embodiments, the door opening device is controlled and operated using a program, for example a software program or an application installed in the remote control or the handheld device. In some embodiments, the program presents a virtual buttons and/or icons on a planar screen. In some embodiments, the user opens additional screens and/or options and/or menus by touching the planar screen in locations where the buttons and/or the icons are visualized. Reference is now made to FIGS. 8A-8G and 9A-9L depicting an application program or a software program, according to some embodiments of the inventions.

According to some exemplary embodiments, the opening screen, for example screen 820, comprises an activation button, for example button 822. In some embodiments, button 822 is used to select whether to activate the device for closing or opening the door. Additionally, the screen includes a menu icon 826 and/or an accessibility icon 824.

Figure 8B:
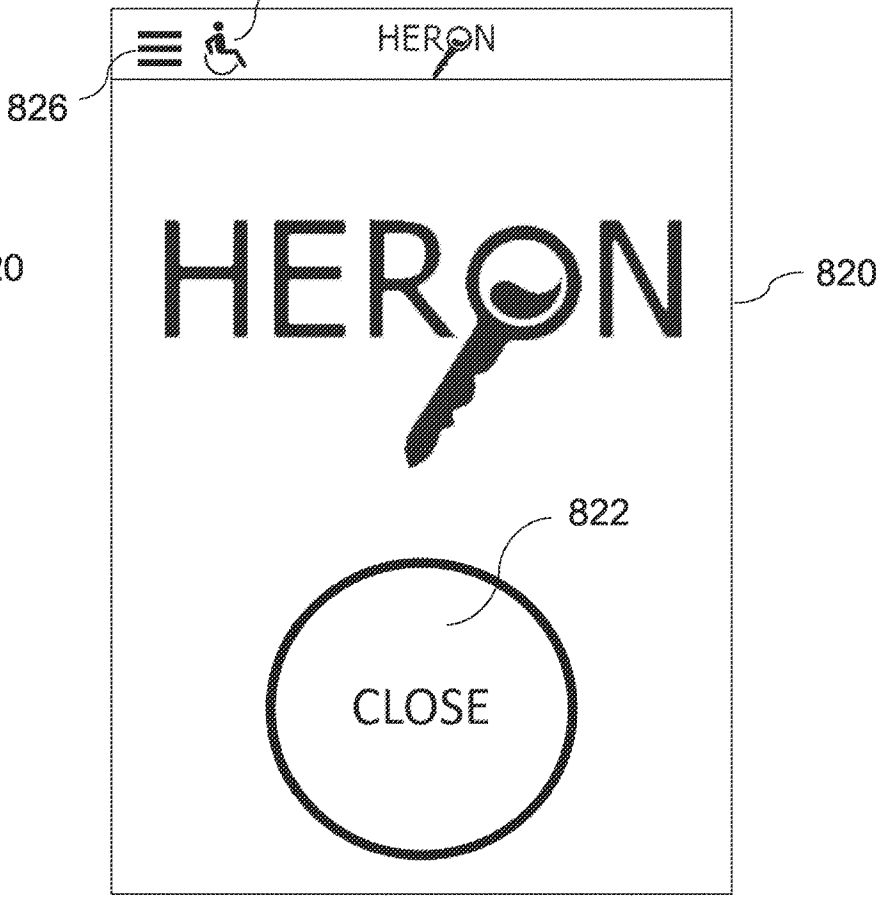
FIGS. 8A-8G and 9A-9L are schematic screen shots of an application program for controlling and/or operating the device, according to some embodiments of the invention.
Figure 8A:
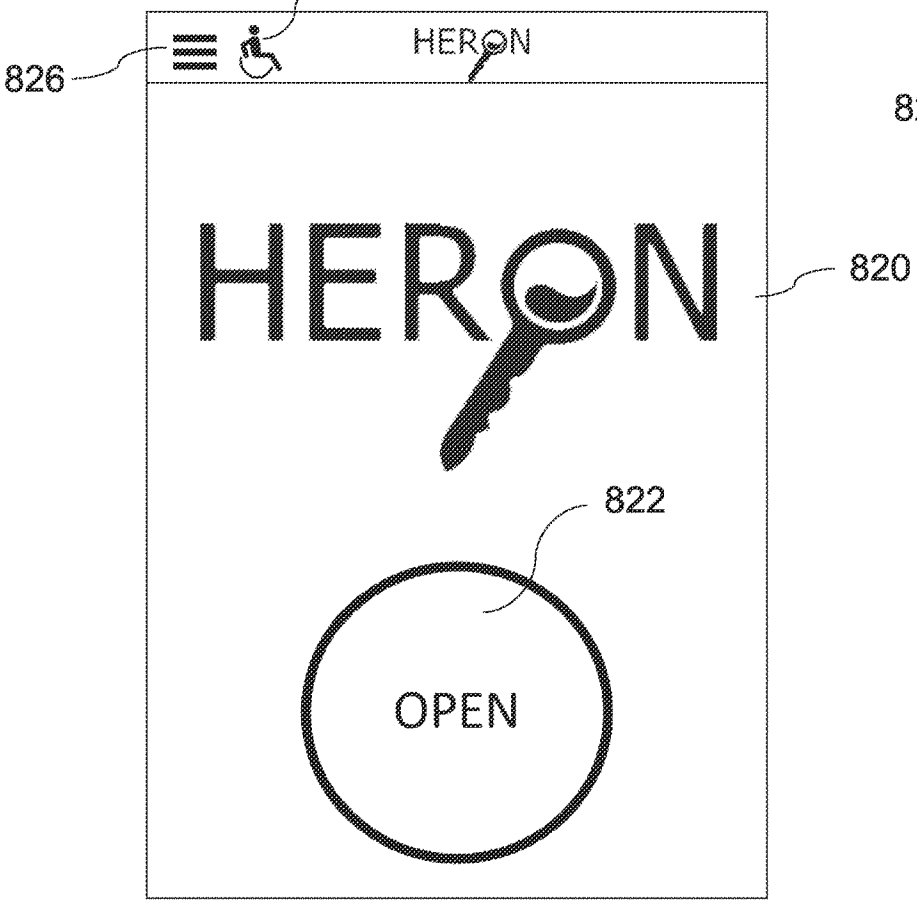
Figure 8D:
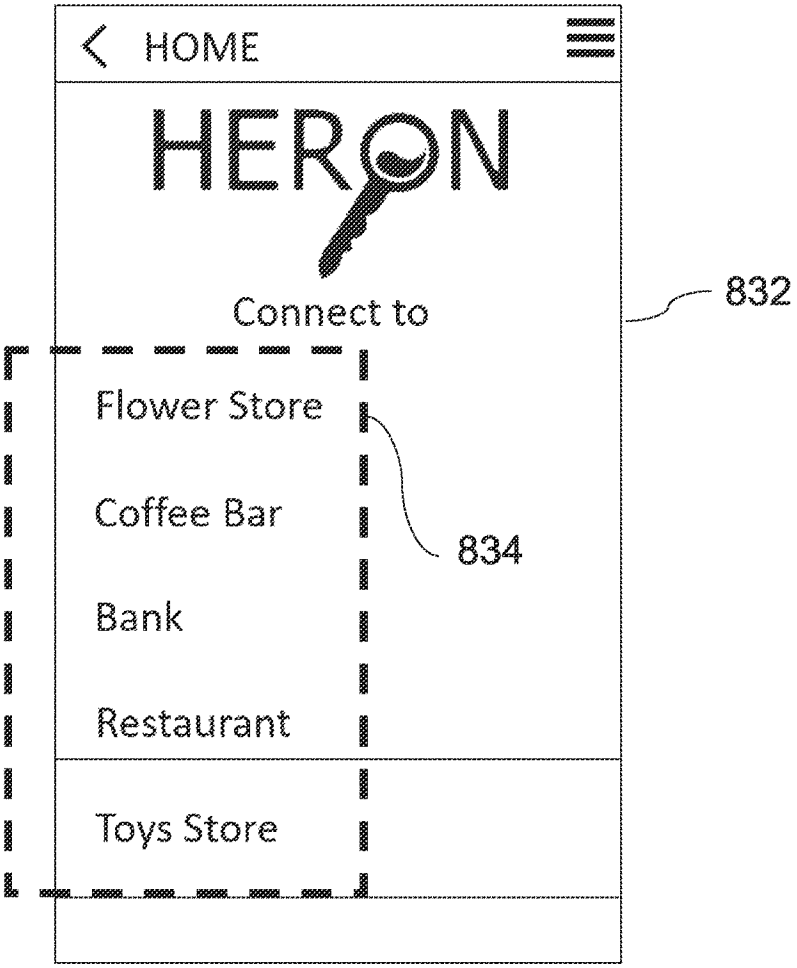
Figure 8C:
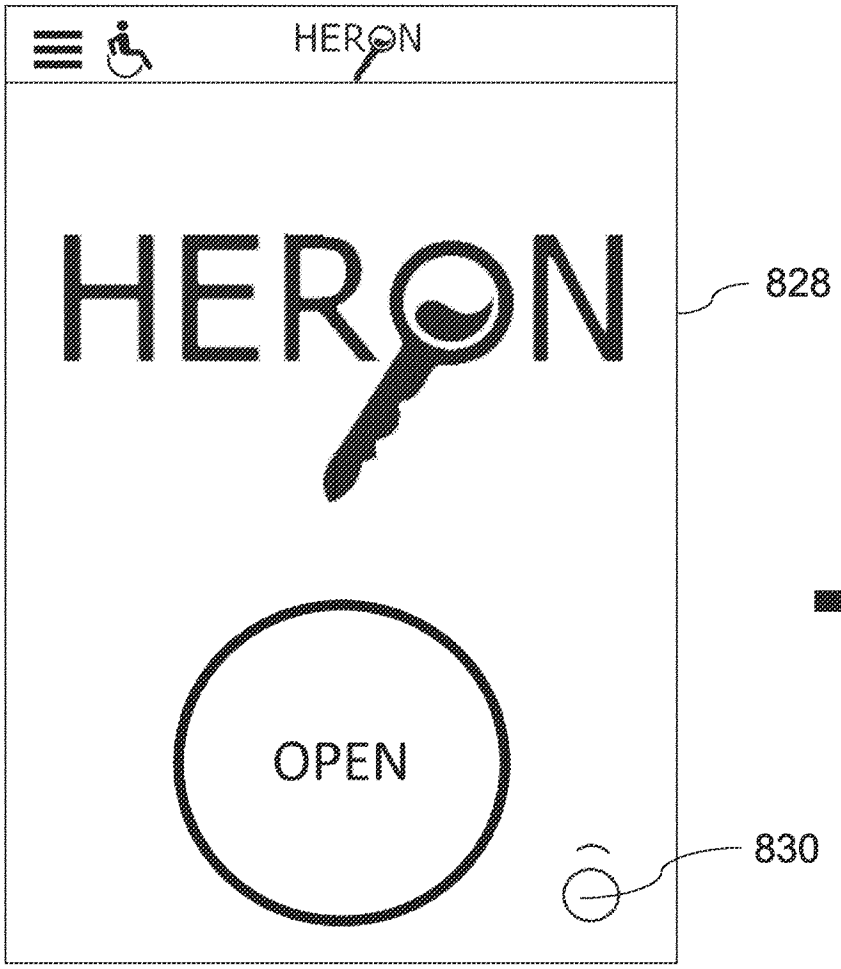
Figure 8F:
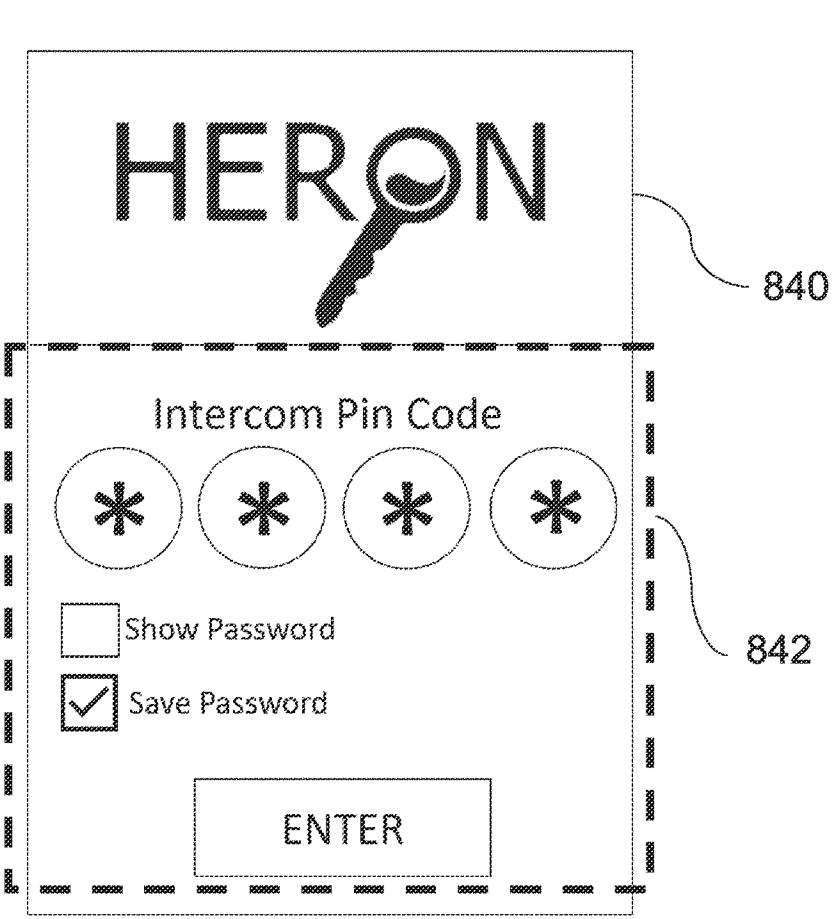
Figure 8E:
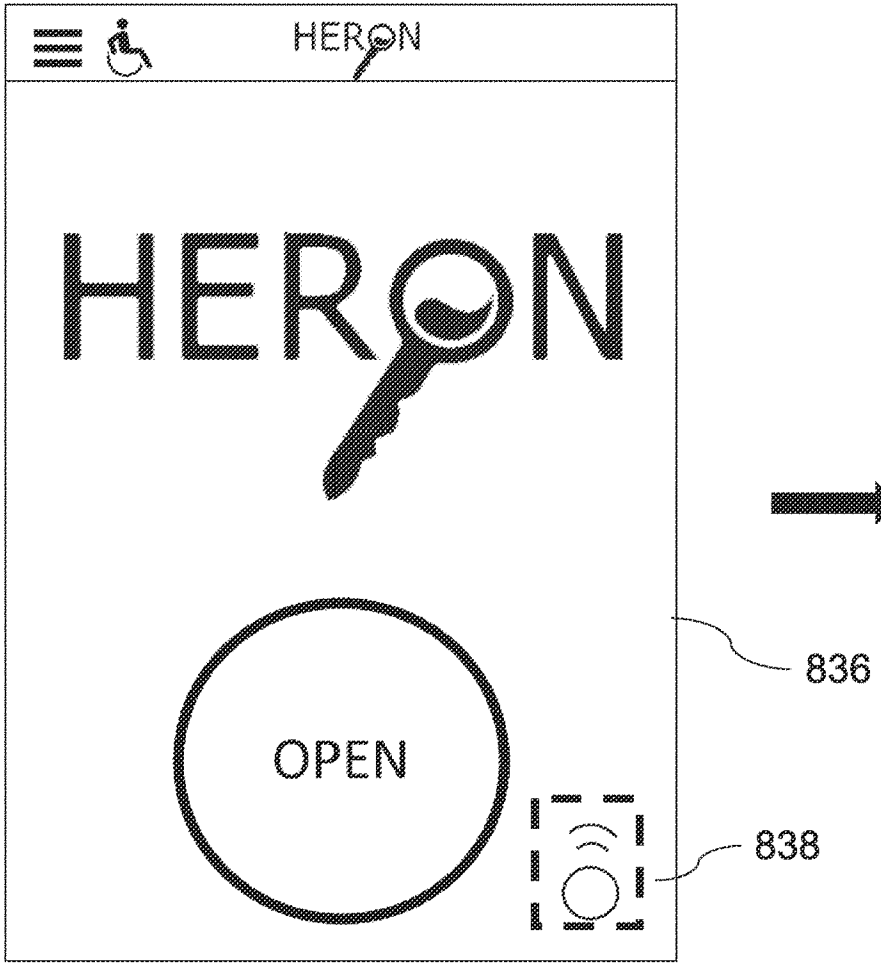

According to some exemplary embodiments, when touching the button 822 to open a door, the program presents on a screen a connection icon 830, for example as shown in screen 828 in FIG. 8C. In some embodiments, the program presents a list 834, for example as shown in FIG. 8D which includes door opening devices, that optionally can be controlled and/or operated using the program software. In some embodiments, the user selects a device from list 834.

According to some exemplary embodiments, when a device is selected from the list 834, a connection attempt is to the selected device is performed, as indicated by the connection icon 838 in screen 836. In some embodiments, if the connection is successful, then a request for a password and/or a pin code window 842 is presented to the user, for example as shown in screen 840.

Figure 8G:
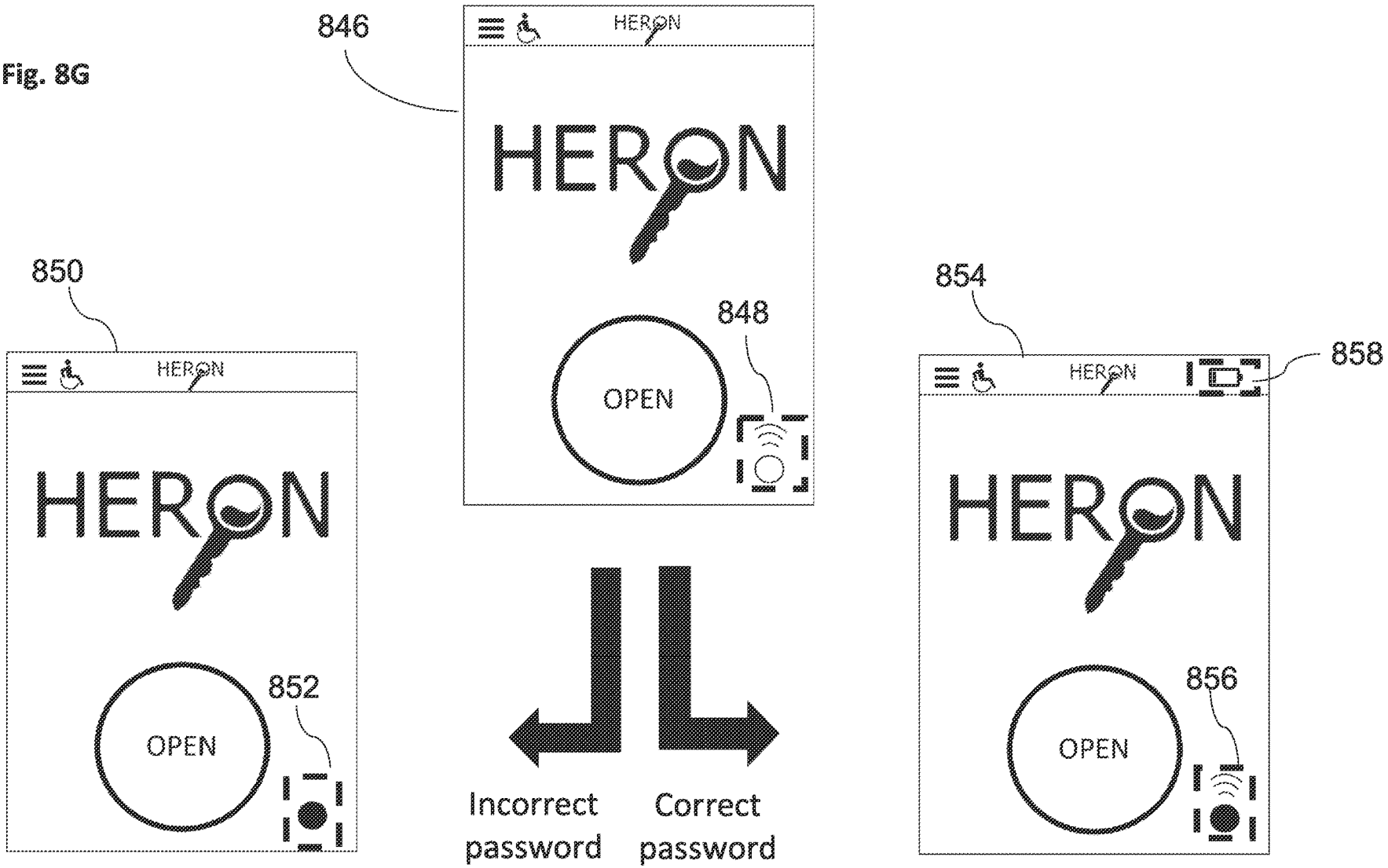

According to some exemplary embodiments, for example as shown in FIG. 8G, once the password is entered, a connection trial is made in screen 846, as is indicated by the change in icon 846. In some embodiments, if the password is incorrect, the connection to the device fails, as shown in screen 850 and as by icon 852 which indicated a non-active connection. Alternatively, if the password is correct, for example as shown in screen 854, the program software presents information to the user about the selected door opening device, for example by presenting a battery icon 858 which indicates the electrical charging status of the battery. In some embodiments, when a connection is established, an active connection icon 856 is presented to the user.

Figure 9A:
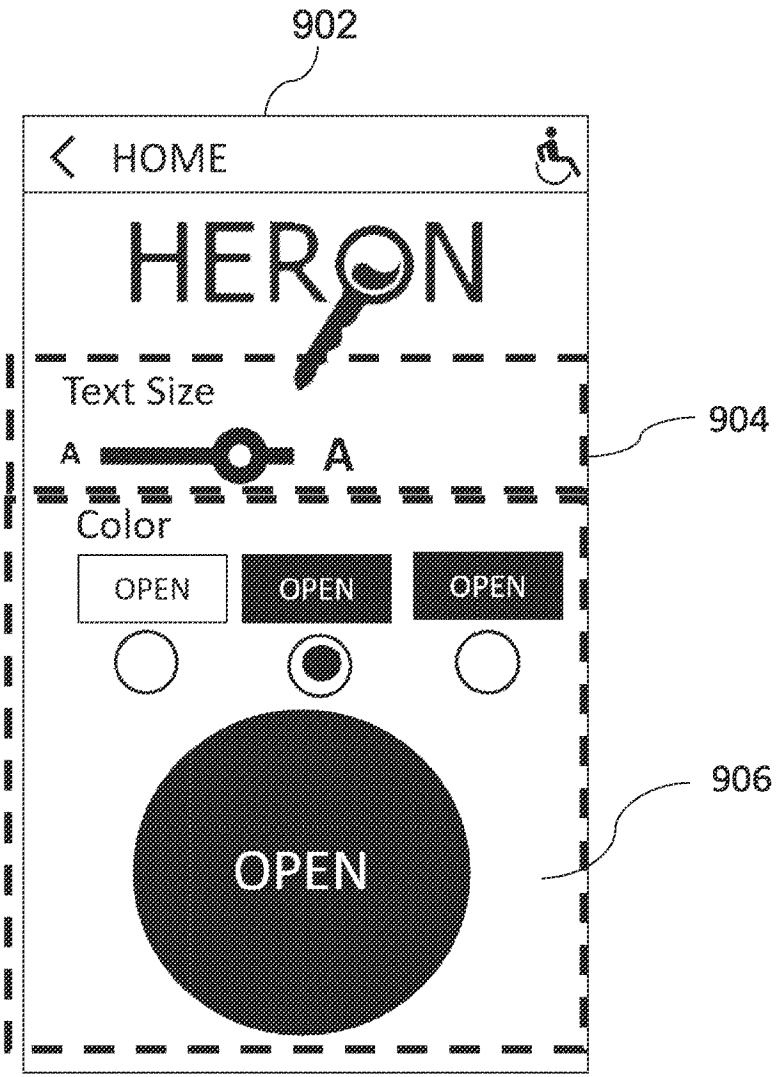
Figure 9A:
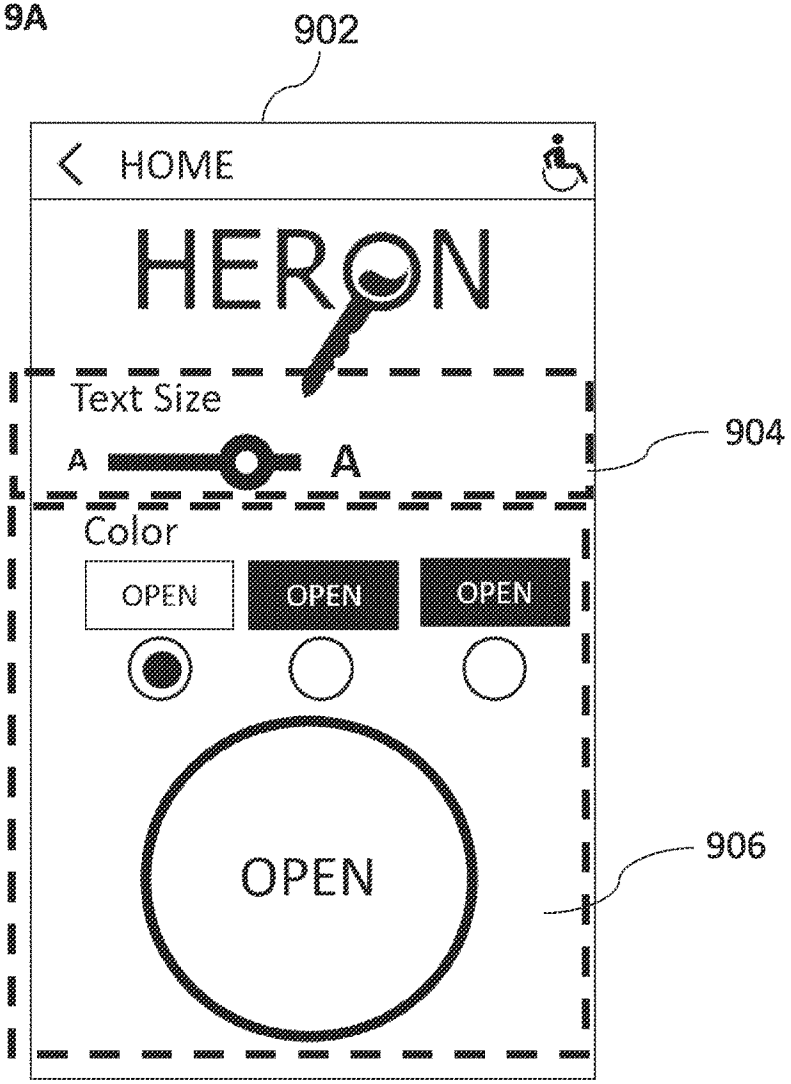

According to some exemplary embodiments, if the accessibility icon 824, for example accessibility icon in screen 820, is pressed or touched by the user, a software appearance screen 902 is presented to the user. In some embodiments, for example as shown in FIG. 9A, a user can modify the text and/or font size in 904. Alternatively or additionally, the user can modify the color or combination of colors used to present button 822 in window 906.

Figure 9B:
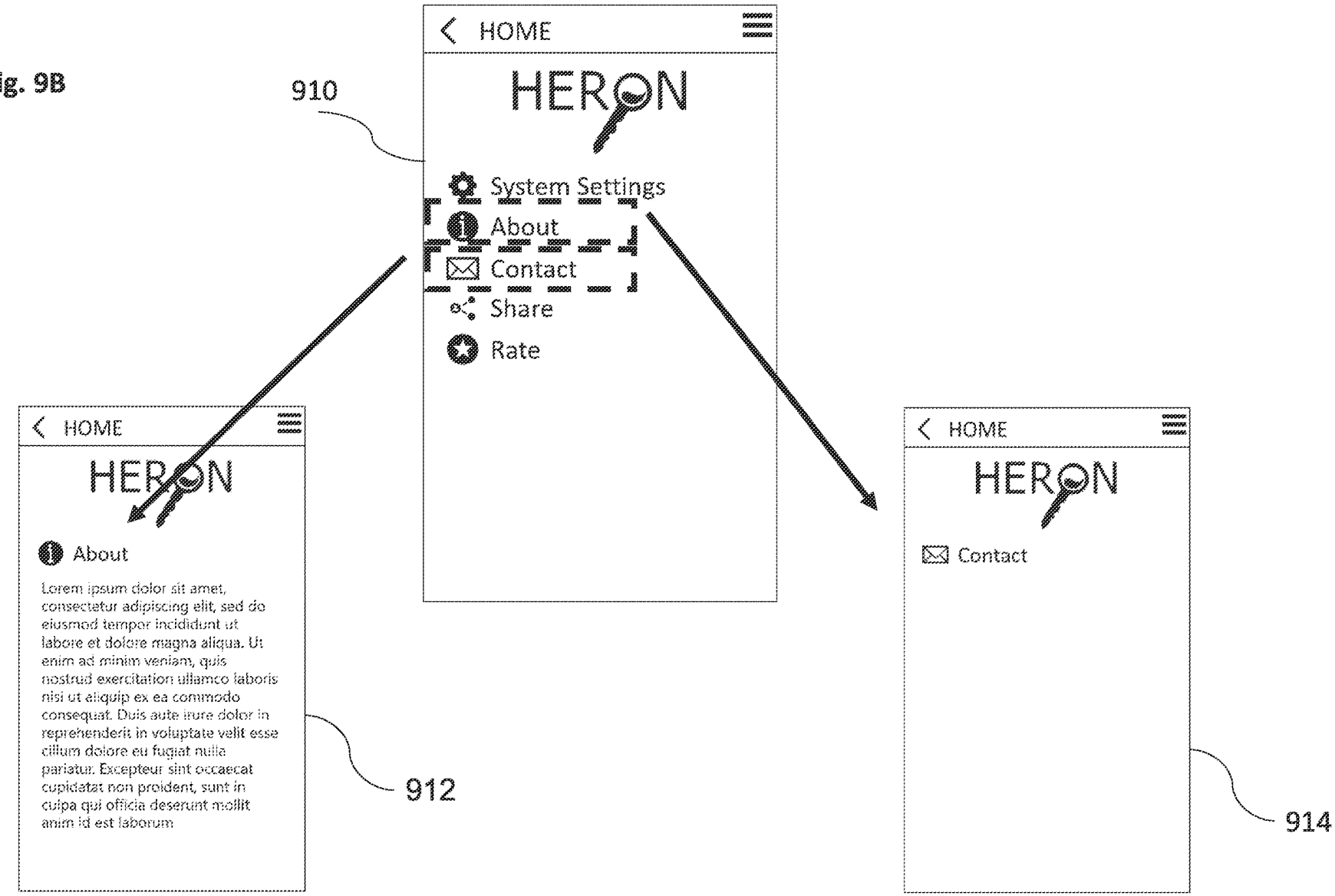
Figure 9C:
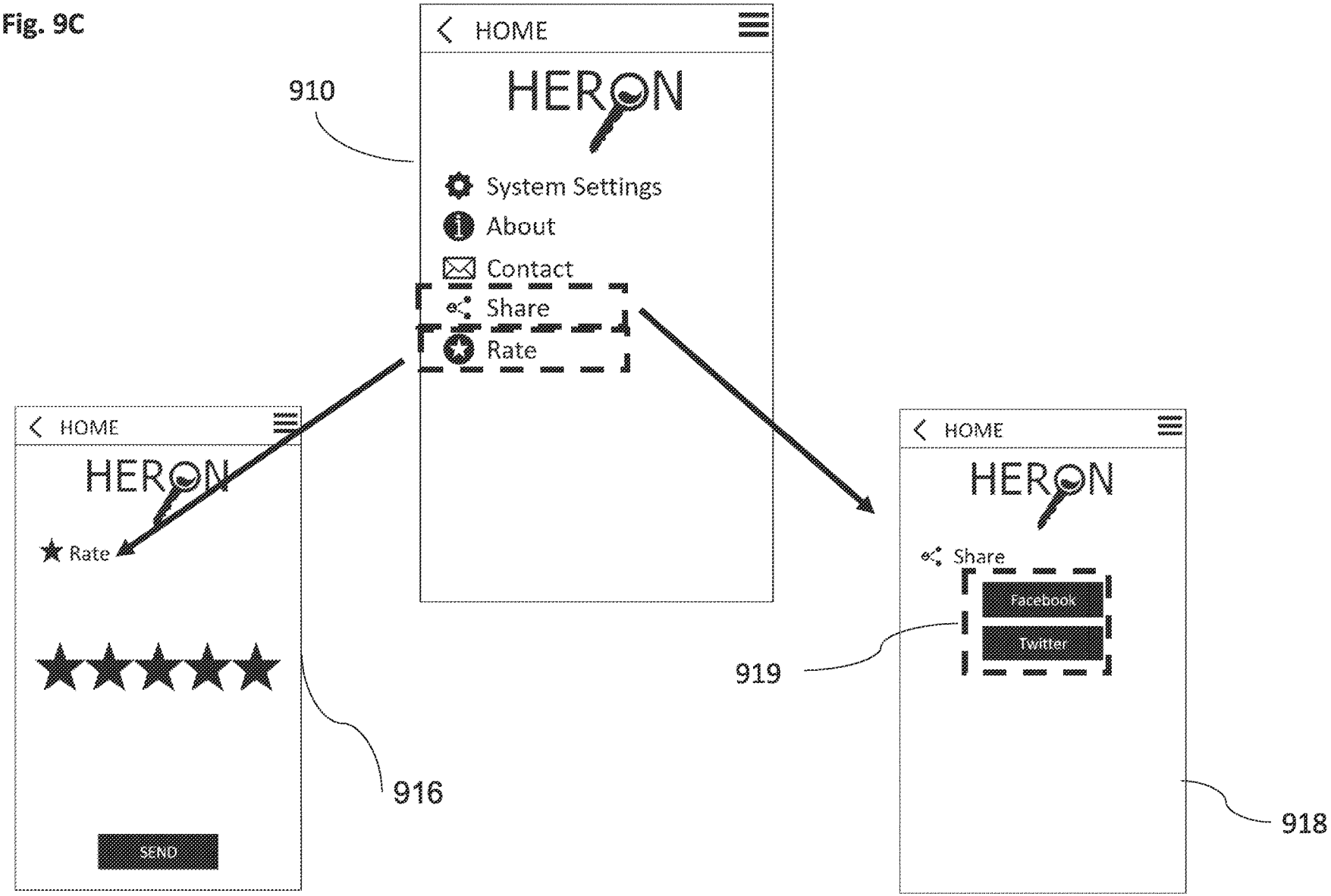
Figure 9D:
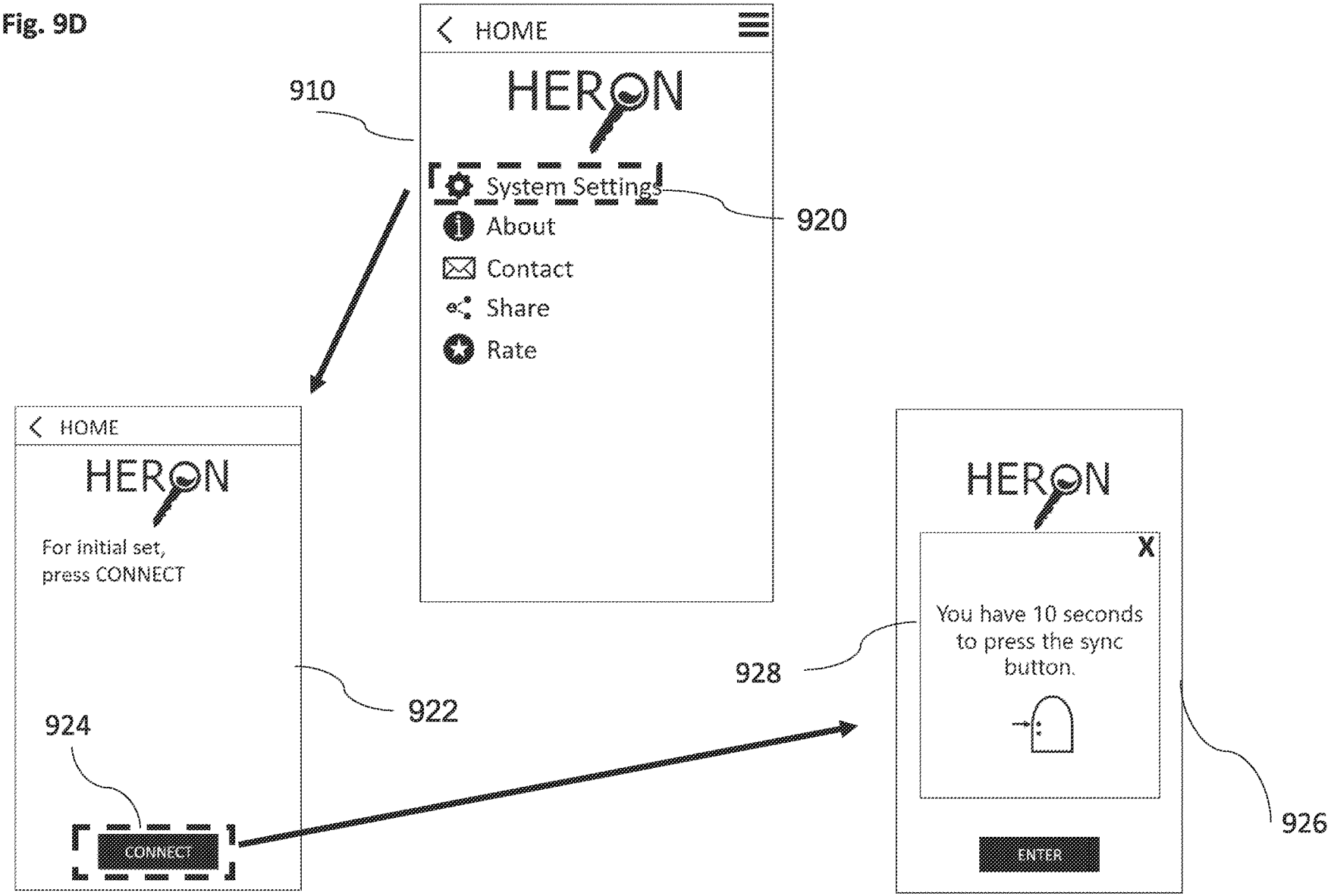
Figure 9E:
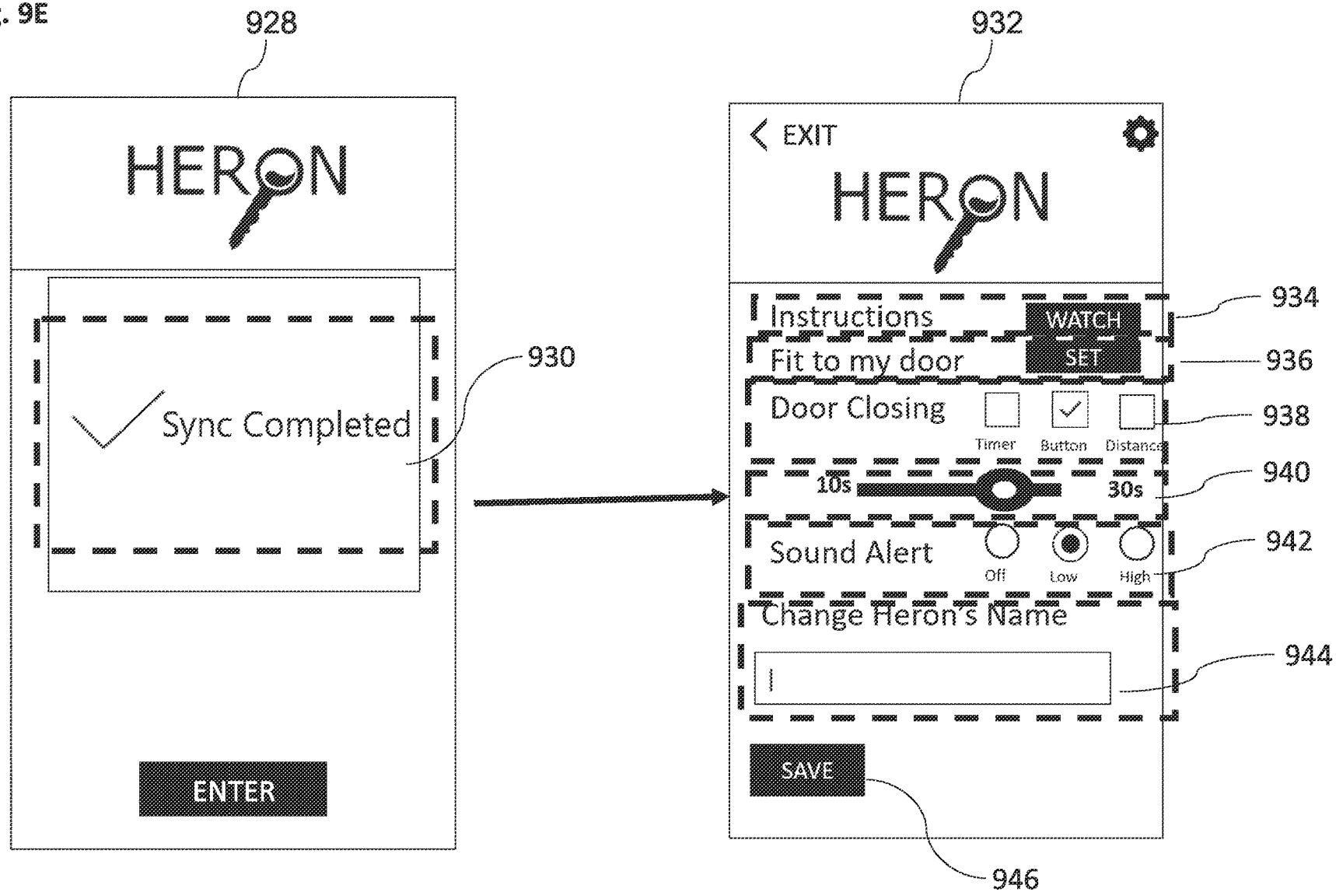
Figure 9F:
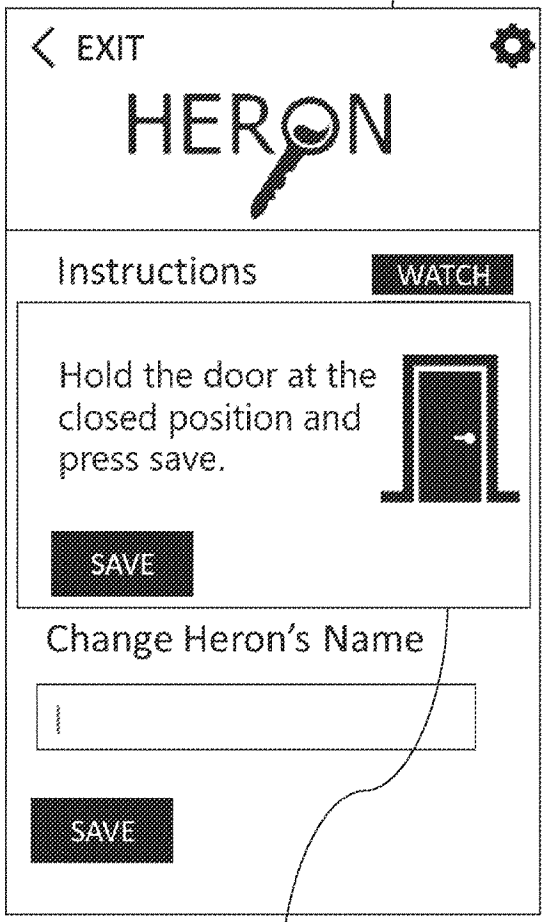
Figure 9G:
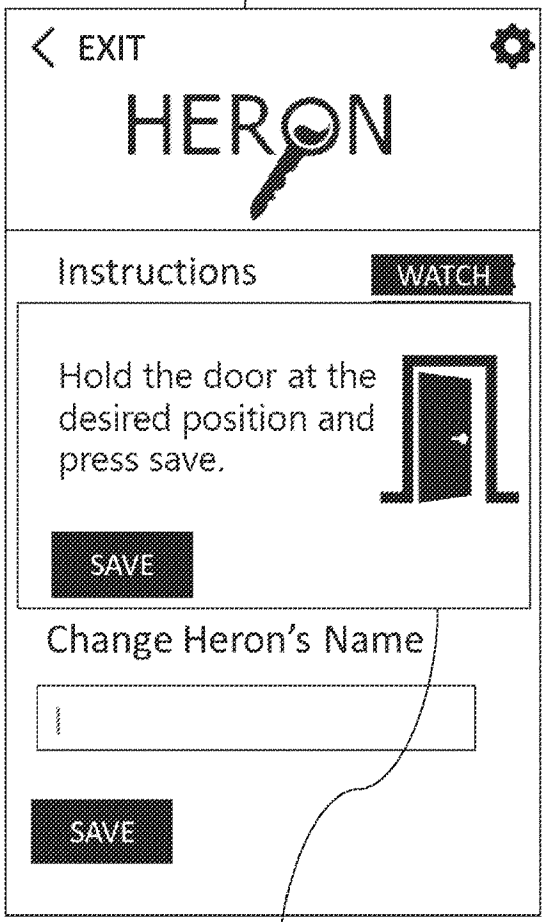
Figure 9H:
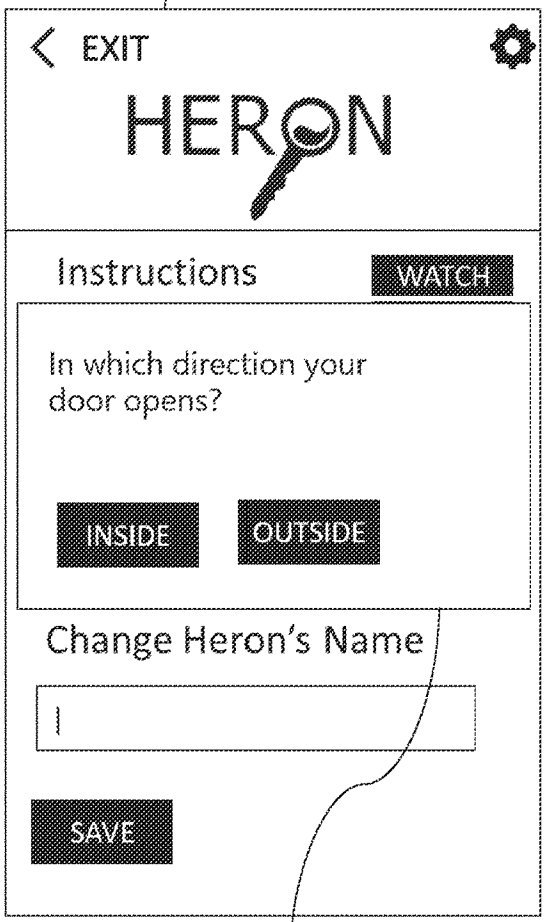
Figure 9I:
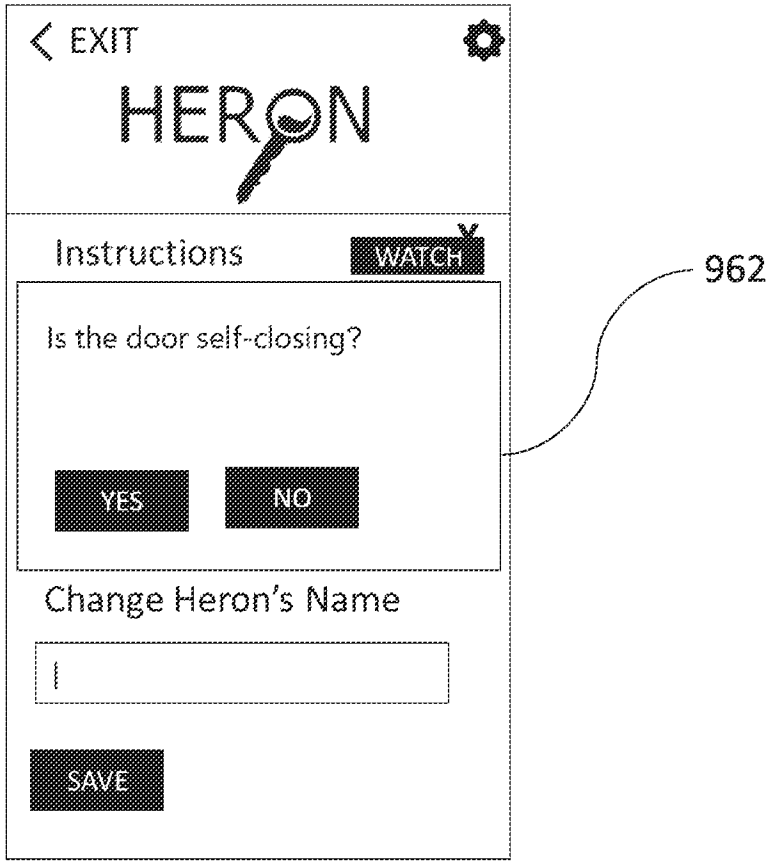

According to some exemplary embodiments, for example as shown in FIG. 9B, when a user touches or presses the menu icon 826, menu screen 910 is presented. In some embodiments, menu screen 910 includes one or more of the following options, System Settings, About, Contact, Share and/or Rate. In some embodiments, when a user presses or touches the About option, a textual section describing the software and/or the device is presented, for example as shown in screen 912. In some embodiments, when a user presses or touches the Contact option in screen 910, a contact icon in screen 914 is presented. In some embodiments, pressing or touching the contact icon in screen 914 allows a user to interact with the program software and/or the device customer, optionally by sending an e-mail.

According to some exemplary embodiments, when a user presses or touches the share icon in screen 910, an option to share information on the software program and/or information about the door opening device is presented in a share menu 919 in screen 918. In some embodiments, the share menu includes the option to share information regarding the program software and/or the door opening device in social networks, for example Facebook® or Tweeter.

According to some exemplary embodiments, when a user presses or touches the Rate icon in screen 910, an option to rate the software program and/or the door opening device is presented in screen 916.

According to some exemplary embodiments, when a user presses or touches the System Settings section 920 in screen, a screen 922 is opened. In some embodiments, screen 922 presents an option to perform an initial setting of the door opening device, and/or to reset the settings of the door opening device, optionally by pressing the Connect 924 icon. In some embodiments, when the Connect 924 is pressed or touched, the user needs to press a button on the door opening device to synchronize the software program with the device. In some embodiments, a request to synchronize the software program with the door opening device is presented to the user, for example as shown in screen 926 in section 928.

According to some exemplary embodiments, if synchronization with the door opening device is successful, an indication is presented to the user, for example a "Sync Completed" indication in window 930. In some embodiments, when synchronization is completed a new window 932 which lists different door opening device settings options to the user. In some embodiments, when pressing or touching the instructions section 934, a new window providing instructions to the user is presented.

According to some exemplary embodiments, when pressing or touching the door closing section 938, a user can select an option for closing the door, for example closing the door using a timer, closing the door when a button in the application software is activated, or closing the door when the user is in a desire distance from the door opening device.

According to some exemplary embodiments, when pressing or touching a timer section 940 in screen 932, a user adjusts the time period required for closing or opening the door.

According to some exemplary embodiments, when pressing or touching a sound alert section 942 in screen 932, a user select whether to allow the device to generate a sound alert and/or the sound level of the sound alert.

According to some exemplary embodiments, a user can change the name of the door opening device in the software program in name changing section 944 in screen 932.

According to some exemplary embodiments, when the door opening parameters are modified in screen 932, the changes are saved by pressing or touching the save icon 946.

According to some exemplary embodiments, when the fit to my door section 936 in screen 932 is selected, then the software program allows synchronizing the position of the door with the operating program parameters of the door opening device. In some embodiments, to synchronize the position of the door, screen 950 presents a request for the user to place the door in a closed position or in a desired closing position and press save in section 952. Additionally, the user is requested to open the door to a fully open position or to a desired open position and press save, as presented in section 953 of screen 954. In some embodiments, holding the door in a closed and open positions, allows, for example to synchronize the angle sensor 243. and/or accelerometer 239 of the door opening device that are used for determining the opening angle of the door.

According to some exemplary embodiments, the user selects the opening direction of the door in section 960 of screen 958. Additionally, the user selects whether the door is a self-closing door, for example using the door closer device 710.

Figure 9J:
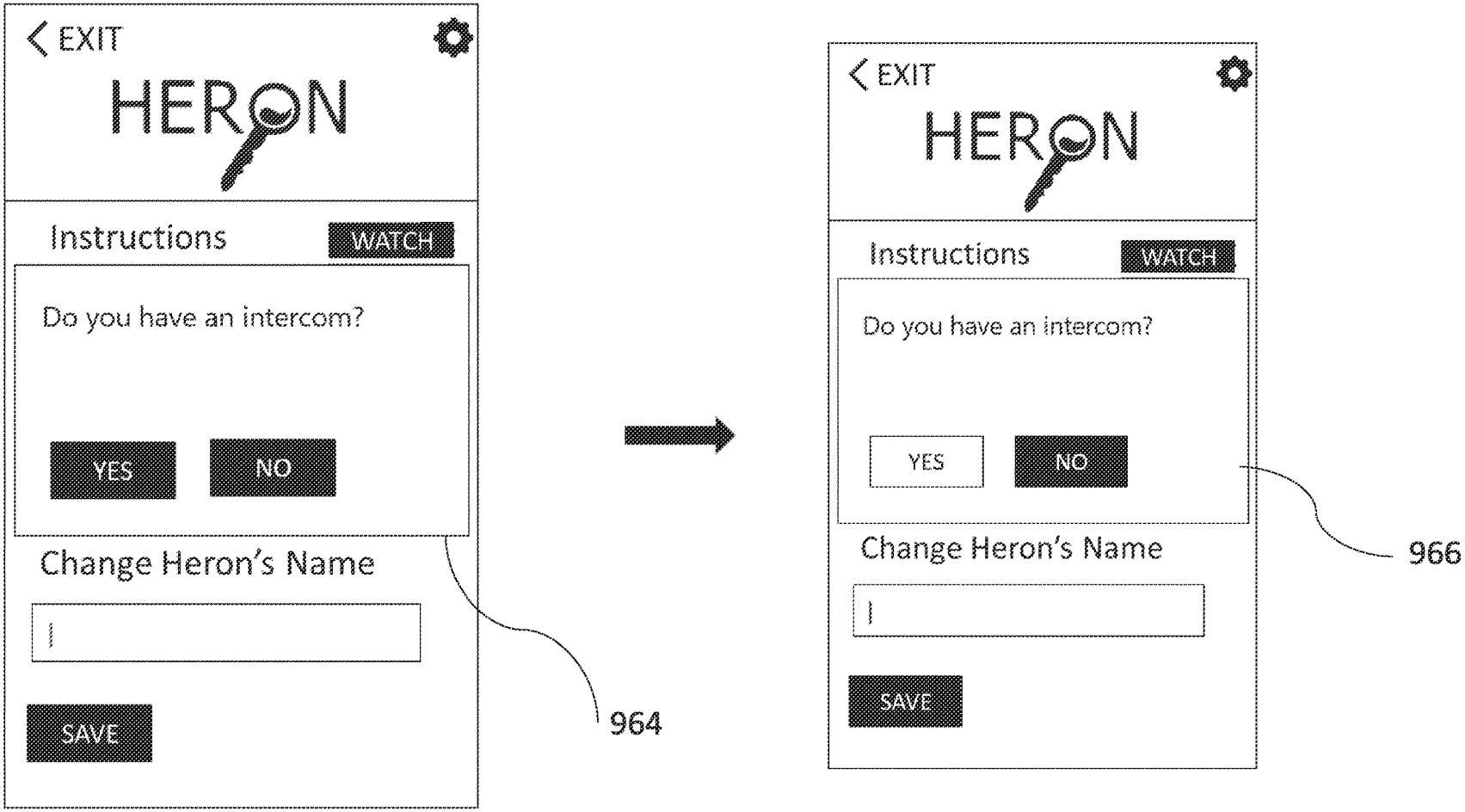
Figure 9K:
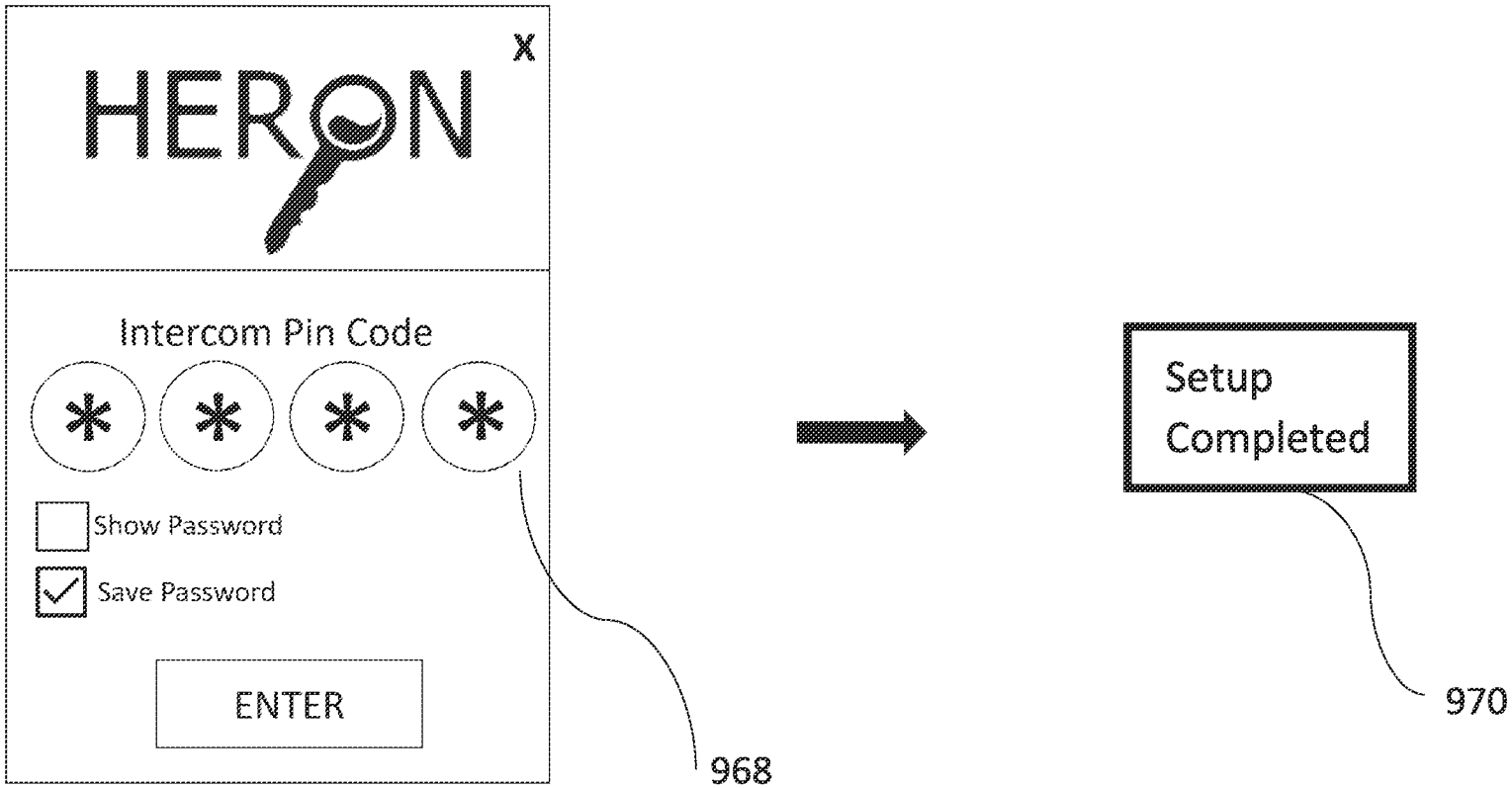
Figure 9L:
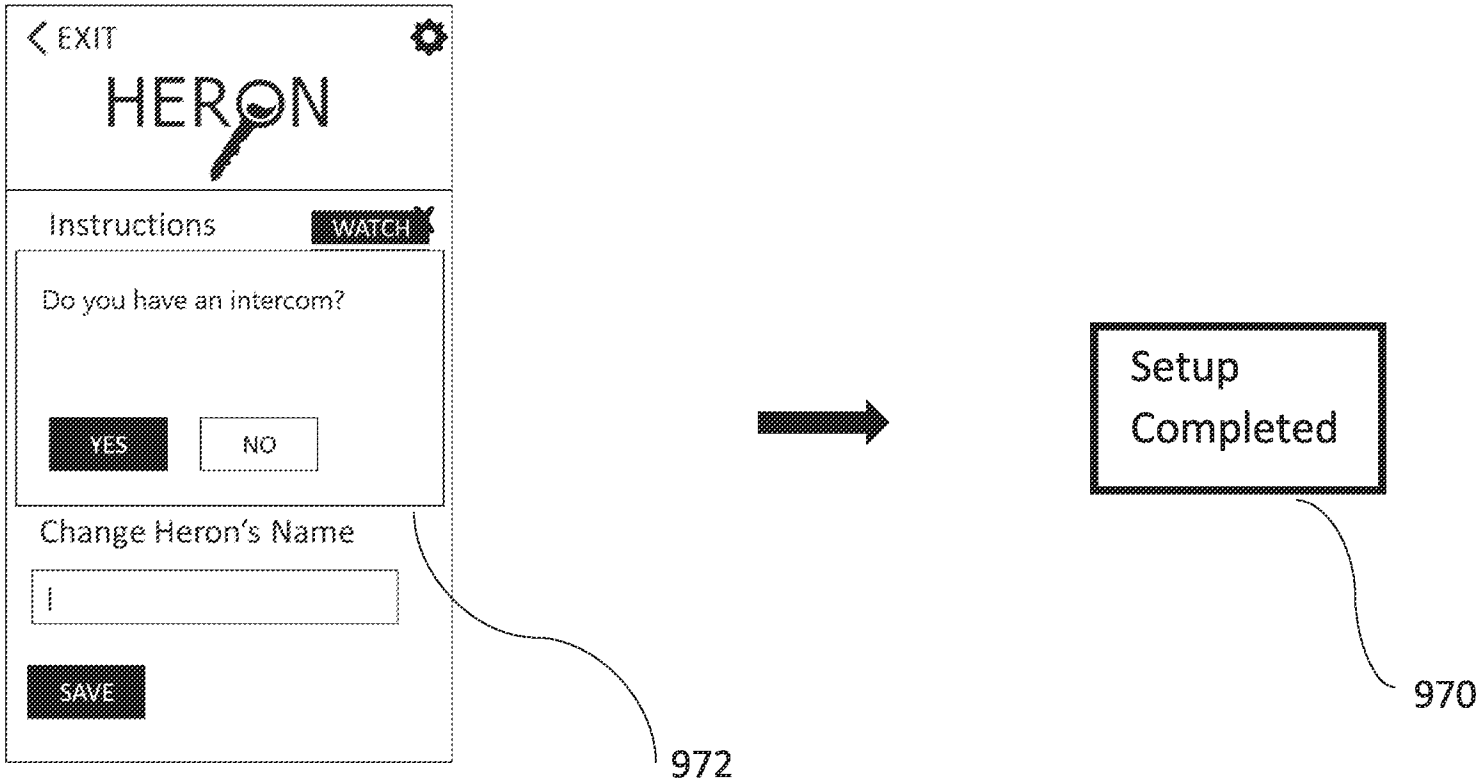

According to some exemplary embodiments, a user indicates whether an intercom is connected to the door in screen section 964 shown in FIG. 9J. In some embodiments, if a user indicated that an intercom is connected to the door in section 966, then a request to insert the intercom pin code or password is presented in section 968, as shown in FIG. 9K. In some embodiments, when the intercom password is inserted or when an intercom is not connected to the door, as indicated in window 972, setup is completed at 970.

It is expected that during the life of a patent maturing from this application many relevant wheel actuators will be developed; the scope of the term wheel actuator is intended to include all such new technologies a priori. As used herein with reference to quantity or value, the term "about" means "within ±10% of".

The terms "comprises", "comprising", "includes", "including", "has", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular forms "a", "an" and "the" include plural references unless the context clearly dictates otherwise. For example, the term "a compound" or "at least one compound" may include a plurality of compounds, including mixtures thereof.

Throughout this application, embodiments of this invention may be presented with reference to a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as "from 1 to 6" should be considered to have specifically disclosed subranges such as "from 1 to 3", "from 1 to 4", "from 1 to 5", "from 2 to 4", "from 2 to 6", "from 3 to 6", etc.; as well as individual numbers within that range, for example, 1, 2, 3, 4, 5, and 6. This applies regardless of the breadth of the range.

Whenever a numerical range is indicated herein (for example "10-15", "10 to 15", or any pair of numbers linked by these another such range indication), it is meant to include any number (fractional or integral) within the indicated range limits, including the range limits, unless the context clearly dictates otherwise. The phrases "range/ranging/ranges between" a first indicate number and a second indicate number and "range/ranging/ranges from" a first indicate number "to", "up to", "until" or "through" (or another such range-indicating term) a second indicate number are used herein interchangeably and are meant to include the first and second indicated numbers and all the fractional and integral numbers therebetween.

Unless otherwise indicated, numbers used herein and any number ranges based thereon are approximations within the accuracy of reasonable measurement and rounding errors as understood by persons skilled in the art.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A motorized door opening device, comprising:

a) at least one wheel, configured to be lowered to a surface;

wherein said at least one wheel is configured to be forced against the surface with a force sufficient to ensure friction between said at least one wheel and the surface and to prevent slipping of said at least one wheel relative to the surface;

b) an electric motor including a rotor coupled to rotate said at least one wheel;

c) a wheel actuator coupled between the door and said at least one wheel, said wheel actuator configured to lower said at least one wheel to the surface in response to a wheel lowering signal; and d) control circuitry configured to signal said wheel actuator to lower said at least one wheel by generating said wheel lowering signal and push down said at least one wheel to create friction; and e) a door attachment member configured to attach said electric motor and said wheel actuator to a bottom part of the door;

whereby rotation of said at least one wheel after lowering of said at least one wheel causes said at least one wheel to rotate in contact with the surface and move the door.

2. The device according to claim 1, comprising a wireless receiver which signals said control circuitry to generate said lowering signal in response to reception of a wireless signal thereby.

3. The device of claim 2, wherein said wireless receiver signals said control circuitry to activate said device in response to reception of a wireless signal from an intercom device.

4. The device of claim 2, further comprising a transmitter which transmits wireless signals to an intercom device.

5. The device according to claim 1, further comprising a gear component connected to said electric motor and configured to change the torque delivered to said at least one wheel by said electric motor.

6. The device according to claim 1, wherein said door is configured to be manually opened by applying a force against said door by a user, when said wheel lowering signal is not received.

7. The device according to claim 1, wherein said wheel actuator comprises an over current sensor, wherein said force is determined by measuring electric current of said wheel actuator by said current sensor.

8. The device according to claim 1, further comprising a door state sensor for determining a relative and/or an absolute position of the door.

9. The device according to claim 8, wherein said door state sensor comprises a gyroscope or an optical sensor.

10. The device according to claim 1, further comprising an accelerometer for sensing a door movement.

11. A door opening system comprising the motorized door opening device of claim 1, and a remote control, wherein said remote control transmits a wireless signal to said motorized door opening device.

12. The system according to claim 11, wherein said remote control comprises a handheld device configured to open said door by transmitting said wireless signal using a software program or an application program.

13. The system of claim 11, further comprising an intercom device, and wherein said motorized door opening device delivers signals to said intercom device by a transmitter of said motorized door opening device.

14. The system of claim 11, further comprises an intercom device, and wherein said motorized door opening device receives signals from said intercom device by a receiver of said motorized door opening device.

15. The device according to claim 1, wherein said control circuitry is configured to adjust said force to the slippage.

16. The device according to claim 1, wherein said wheel actuator is configured to raise said at least one wheel above the surface in response to a wheel raising signal;

wherein said control circuitry is configured to signal said wheel actuator to raise said at least one wheel by generating said wheel raising signal.

* * * * *